US007128491B2

(12) United States Patent
Kobayashi

(10) Patent No.: US 7,128,491 B2
(45) Date of Patent: Oct. 31, 2006

(54) COMPOSITE WRITING INSTRUMENT

(75) Inventor: Seiichi Kobayashi, Yokohama (JP)

(73) Assignee: Mitsubishi Pencil Co., Ltd., Tokyo (JP)

( * ) Notice: Subject to any disclaimer, the term of this patent is extended or adjusted under 35 U.S.C. 154(b) by 130 days.

(21) Appl. No.: 10/944,826

(22) Filed: Sep. 21, 2004

(65) Prior Publication Data

US 2005/0063767 A1 Mar. 24, 2005

(30) Foreign Application Priority Data

Sep. 24, 2003 (JP) ..... 2003-330906
Oct. 7, 2003 (JP) ..... 2003-347701

(51) Int. Cl.
*A46B 11/02* (2006.01)
*B43K 27/00* (2006.01)
*B43K 5/16* (2006.01)

(52) U.S. Cl. ..... 401/188 A; 401/30; 401/109

(58) Field of Classification Search ..... 401/188 R, 401/188 A, 29–33, 209, 109
See application file for complete search history.

(56) References Cited

U.S. PATENT DOCUMENTS 3,424,537 A * 1/1969 Henriksen ..... 401/142
3,947,136 A * 3/1976 Adams ..... 401/188 A
4,472,462 A * 9/1984 Apice et al. ..... 427/288
5,716,151 A * 2/1998 Satake ..... 401/188 A

FOREIGN PATENT DOCUMENTS

| | | |
|---|---|---|
| JP | 63-98776 | 6/1988 |
| JP | 1-161081 | 11/1989 |
| JP | 7-506862 | 7/1995 |
| JP | 8-52407 | 2/1996 |
| JP | 2000-62387 | 2/2000 |
| JP | 2001-150865 | 6/2001 |
| JP | 2001-171286 | 6/2001 |
| JP | 2001-205980 | 7/2001 |

* cited by examiner

*Primary Examiner*—David J. Walczak
(74) *Attorney, Agent, or Firm*—Westerman, Hattori, Daniels & Adrian, LLP.

(57) ABSTRACT

In a composite writing instrument having mounted therein a plurality of writing devices including at least one ball-point pen refill equipped with a tip of the ball-point pen at a top end and an ink reservoir section at a rear end so that writing tip portions may be alternately allowed to project and retreat from an front body top, a pumping type pressurization mechanism is provided behind the ball-point pen refill, and a rear end of ink is pressurized by way of knock operation in a situation where a tip end portion has projected from a body end, so as to help the ink flow towards the tip side.

7 Claims, 21 Drawing Sheets

COMPOSITE WRITING INSTRUMENT

BACKGROUND OF THE INVENTION

1. Filed of the Invention

The present invention relates to a composite writing instrument comprising a plurality of writing means at least one of which is a ball-point pen refill equipped with a tip portion of a ball-point pen at the tip and an ink reservoir section at a rear end, so that writing tip portions may selectively be allowed to protrude from a body end, and pumping type pressurization operation may help an ink to flow towards the tip side of the above-mentioned ball-point pen.

2. Description of the Related Art

Examples of a composite writing instrument in which a plurality of writing means are mounted, and writing tip portions are selectively allowed to protrude from a body end, and a writing instrument in which pumping type pressurization operation helps an ink to flow towards the tip side of the above-mentioned ball-point pen, are described in Japanese Laid Open Patent No. 2001-205980 (Patent Document 1), Japanese Laid Open Patent No. 2000-62387 (Patent Document 2), Japanese Laid Open Utility Model No. H01-161081 (Patent Document 3), Japanese Laid Open Patent No. H08-52407 (Patent Document 4), International Publication No. H07-506862 (Japanese Translation of PCT International Application) (Patent Document 5), Japanese Laid Open Patent No. 2001-150865 (Patent Document 6), Japanese Laid Open Patent No. 2001-171286 (Patent Document 7), and Japanese Laid Open Utility Model S63-98776 (Patent Document 8).

Each of the related art documents will be briefly described hereafter.

(Patent Document 1)

It proposes a ball-point pen using an ink which tends to be disrupted in initial writing, and a knock type writing instrument which carries a refill of the ball-point pen allowing correction of a clerical error etc. mainly by concealing it with a white ink.

Those that are proposed in this document can be provided cheaply in terms of costs. However, when a pressurization cylinder is operated to retreat from an advanced state, the inside of the pressurization cylinder tends to be depressurized, so that the ink is urged to flow backwards, whereby there is a disadvantage that recovery of the ink or pressurization performance may be impaired.

Moreover, only one writing means is mounted which consists of a refill for one ball-point. It is not taken into consideration the case where the writing means which consists of a plurality of refills of ball-point pens.

(Patent Document 2)

A plurality of ball-point pen writing means are mounted at least one of which employs an oil-based ink having a low viscosity. When each knock body is knocked, an engagement projection is held in engagement with an engagement step portion at a clip top, thus leaving a writing tip portion to project.

A knock type composite writing instrument is known in which the engagement is released when the clip is put on a breast pocket in the above state, and which is provided with a security mechanism such that a writing tip portion may be retracted into the instrument body.

(Patent Document 3)

A composite writing instrument (multiple type writing instrument) is proposed which is characterized in that a plurality of writing means are mounted, a knock portion is formed to protrude from a rear end of a cap, a rotor (rotating projection member) located at a front side of the knock bar is rotated by knocking a knock bar so as to rotate a cylindrical cam of the cap and advance or retreat and locate the cylindrical cam, and in conjunction with this a writing tip portion is allowed to project or retract through a top end hole of an front body.

(Patent Document 4)

Conventionally, in order to correct a clerical error etc., a liquid applicator using a white pigment is known. Further, since the white pigment and a solvent tend to separate, this type of liquid applicator encloses an ink, a ball, etc. in a flexible container. It is necessary to shake and agitate them when in use. Further, in order to discharge the ink, a side of the container is pressed. However, this is irritating because the ink is not discharged even if a side wall of the container is pushed strongly, when the ink residual quantity decreases.

(Patent Document 5)

A writing instrument is known which uses an ink having a shear thinning viscosity with no need for agitation, however, there is a problem that the ink flows backwards and tends to run out when it is applied upwards.

(Patent Document 6)

A writing instrument is proposed in which a pumping type pressurization mechanism portion is provided in the rear end of a body cylinder, further in the front thereof a follower is disposed in contact with the rear end of the ink so as to follow the ink consumption, and a valve system is disposed in the rear end of the follower, air is pressed and supplied through a rear end hole of the body cylinder by way of advancing operation of the pressurization mechanism portion, during which the valve is opened at a predetermined pressure so that the rear end of the follower is pressurized, to thereby support the ink flow towards the tip side.

However, there is a problem with this writing instrument in that a proper pressure cannot be set up because of deviations in the valve mechanisms (deviations in springs which act on opening and closing the valves, dimensional deviations in rubber-made valves which elastically open and close slits, etc.).

Further, there is a problem that when a ball-point pen is not in use and when the pressure exceeds a predetermined setup value, an external force is improperly applied to a writing tip portion so that the ink bleeds.

Moreover, only a writing means consisting of a refill is mounted, so that it is not taken into consideration the case where the writing means including refills of a plurality of ball-point pens is mounted.

(Patent Document 7)

A knock type writing instrument is proposed in which a pressurization mechanism portion is mounted.

However, similar to the above-mentioned Patent Document 6, there is a problem that a proper pressure cannot be set up for this one because of deviations in valve mechanisms (deviations in springs which act on opening and closing valves, dimensional deviations in rubber-made valves which elastically open and close slits, etc.).

Further, there is a problem that when a ball-point pen is not in use and when the pressure exceeds a predetermined setup value, an external force is improperly applied to a writing tip portion so that the ink bleeds.

Moreover, only a writing means consisting of a refill is mounted, so that it is not taken into consideration the case where the writing means including refills of a plurality of ball-point pens is mounted.

(Patent Document 8)

A writing instrument is proposed in which a pressurization mechanism is provided in the rear end so as to help ink flow by way of pumping operation and prevent the ink from flowing backwards.

Further, only one writing means is mounted and it is not taken into consideration the case where a plurality of writing means are mounted.

SUMMARY OF THE INVENTION

The present invention provides a composite writing instrument of a convenient pressurization type having mounted therein at least one ball-point pen refill being supported by a pressurization operation so as to allow writing, such as a ball-point pen using an ink which tends to be disrupted in initial writing, a ball-point pen in which various fillers (metal powder) are mixed in an ink, a ball-point pen filled up with an ink, allowing handwriting on a paper to be eliminated easily by scratching with a rubber, a ball-point pen which allows correction of a clerical error etc. by concealing it with a white ink, or the like.

Further, the present invention provides a composite writing instrument of the pressurization type which solves the problem that when the pressurization cylinder is retreated from an advanced state, the inside of a pressurization cylinder is depressurized, so that the inside of refill is depressurized thus spoiling recovery of an ink and pressurization performance.

In order to attain the above-mentioned aims, the composite writing instrument in accordance with the present invention is a composite writing instrument having mounted therein a plurality of writing means including at least one ball-point pen refill equipped with a tip of the ball-point pen at a top end and an ink reservoir section at a rear end so that writing tip portions may be alternately allowed to project and retreat from an front body top, wherein a pumping type pressurization mechanism is provided behind the above-mentioned ball-point pen refill, and a rear end of ink is pressurized by way of knock operation in a situation where a tip end portion has projected from a body end, so as to help the ink flow towards the tip side.

In other words, the composite writing instrument in accordance with the present invention is characterized by comprising the plurality of writing means at least one of which is the ball-point pen refill filled up with the ink which receives the pumping type pressurization operation.

DETAILED DESCRIPTION OF PREFERRED EMBODIMENTS

FIRST EXAMPLE OF THE INVENTION

Figure 1:
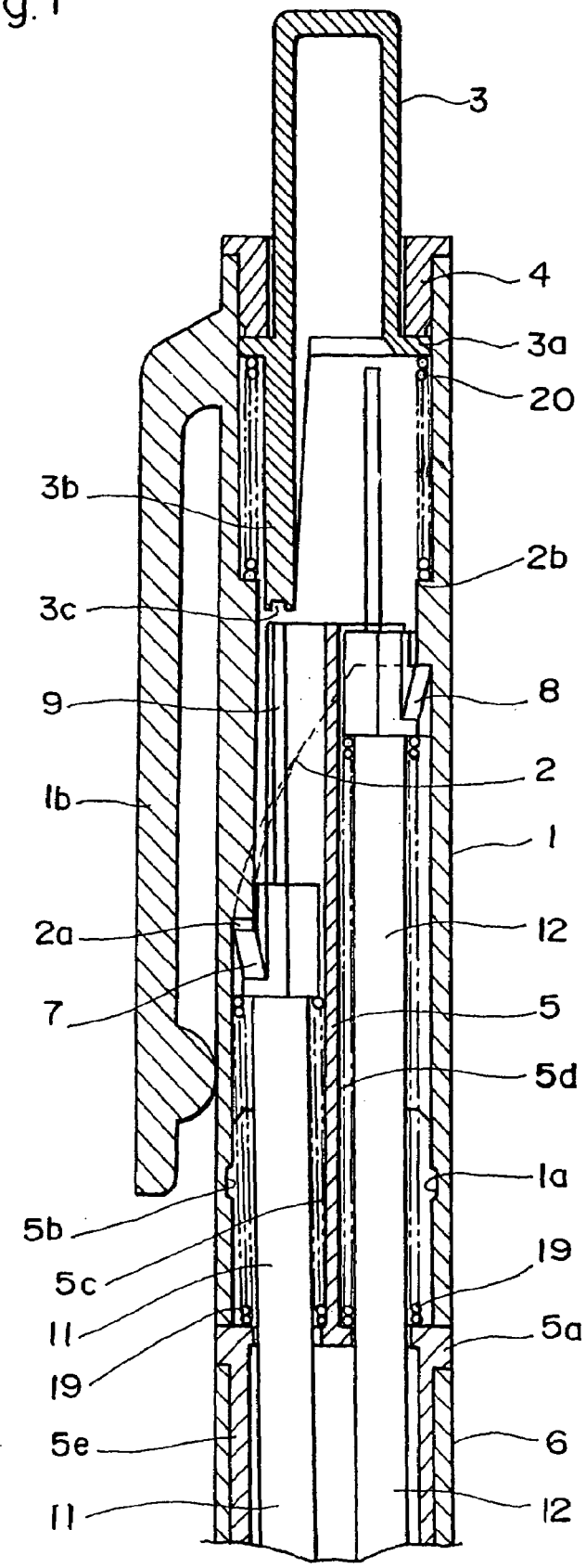
FIG. 1 is a longitudinal sectional view showing the second half part of a composite writing instrument which is a first example of the present invention, where one writing tip portion projects from a top end hole of an front body.

Firstly, FIGS. 1 through 7 show a first example of the present invention. This example shows a structure in which two ball-point pen refills 13 and 14 are mounted.

Further, a composite writing instrument which is an aim of the present invention is characterized by having at least one ball-point pen refill filled up with an ink which receives a pumping type pressurization operation.

As other writing means, it is possible to employ a conventional ball-point pen (oil-based) which does not receive pressure, a ball-point pen carrying a gel ink (water-based or oil-based), a mechanical pencil which needs knock actuation, etc.

At first, the ball-point pen refill will be described. In addition, the ball-point pen refills 13 and 14 of the example have the same structure, but may basically have different ink colors and drawing widths, for example.

Further, various ball-point pens are employed, such as a ball-point pen using an ink which tends to be disrupted in initial writing, a ball-point pen in which various fillers (metal powder) are mixed in an ink, a ball-point pen filled up with an ink, allowing handwriting on a paper to be eliminated easily by scratching with a rubber, a ball-point pen which allows correction of a clerical error etc. by concealing it with a white ink, a ball-point pen refill supported by a pressurization operation so as to allow writing, a ball-point pen with a water based or oil-based ink having a low viscosity, a ball-point pen with an ink having a shear thinning viscosity, a ball-point pen (oil-based) with a high viscous ink, etc.

Therefore, provision for drought resistance at a tip end portion, and prevention of a forward flow (bleeding ink from the tip end portion) and a back flow of the ink become important for the ball-point pen refill, according to ink specifications, a size of an ink reservoir section, etc.

In order to prevent an ink which is likely to dry and an ink having a low viscosity from drying or flowing forward, a means for bringing a tip end ball into intimate contact with an inner edge of a tip ball holding section is required.

Further, a follower incompatible with an ink is needed at the back end of the ink for preventing the ink from drying and flow backwards.

Moreover, a resin-made follower bar which has a specific gravity substantially equivalent to that of the follower needs to be immersed in the follower, as needed. In addition, the follower can be a follower body made of a silicone rubber etc., for example.

Further, when the ink reservoir section is large in size, a valve mechanism which prevents the back flow of the ink is needed between the rear end of the tip and the ink reservoir section.

However, in the case of an oil-based ink of a high viscosity and an ink reservoir section having a small inner diameter, such provision as described above is not always required in order to prevent the forward flow (bleeding) and the back flow of the ink.

In addition, the structures of the ball-point pen refills 13 and 14 are the same as that mentioned above with reference to FIG. 7. A specific structure of the ball-point pen refill will be described later with reference to FIGS. 5 through 7.

Figure 2:
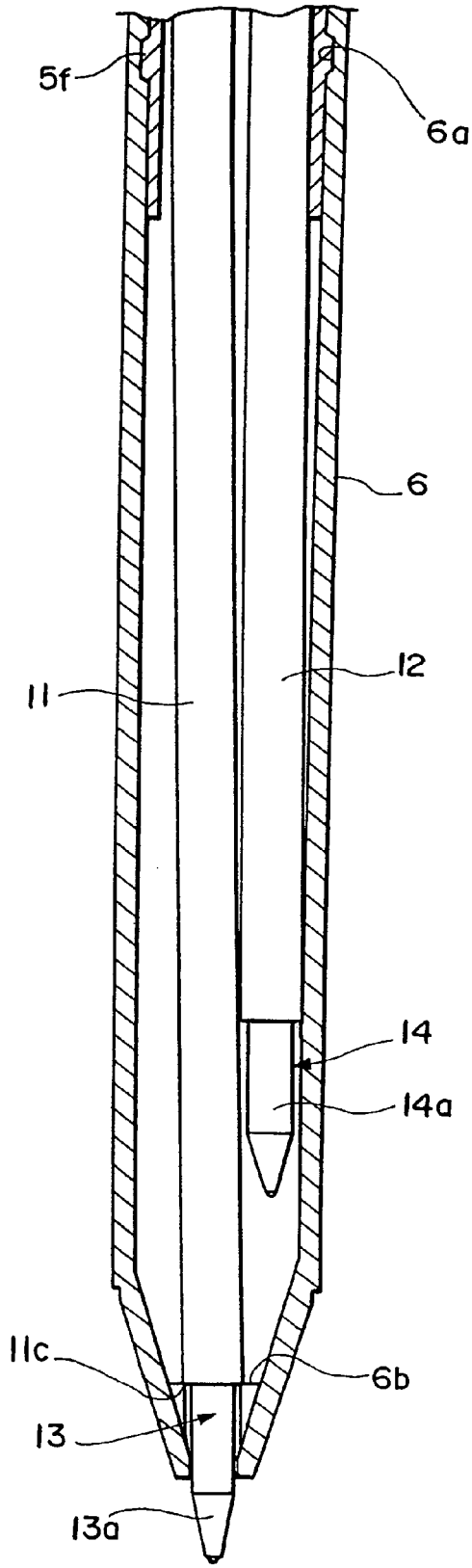
FIG. 2 is a longitudinal sectional view showing the first half part of the composite writing instrument corresponding to FIG. 1.

Firstly, as shown in FIGS. 1 and 2, the composite writing instrument in accordance with the present invention comprises a rear body 1 having a cam slope 2 formed in its inner surface, a knock bar 3 at one end of which is provided a knock piece projecting forward, a guide cylinder 5, an front body 6, a pair of slide members 7 and 8, the ball-point pen refills 13 and 14, etc., as main elements.

As shown in FIG. 1, the guide cylinder 5 includes a pair of guide grooves 5*c* and 5*d* from the substantially central part to the rear, and further includes a flange part 5*a* in front of which is provided a cylinder part 5*e*. As shown in FIG. 2, on the side of the above-mentioned cylinder part 5*e*, there is provided an engagement portion 5*f* having formed a groove such that part of a rib (projection) and the rib (projection) are partitioned. The whole guide cylinder 5 is integrally moulded of a resin.

The above-mentioned guide cylinder 5 is inserted through a back end opening of the front body 6 thereinto, and the engagement portion 5*f* of the guide cylinder 5 is held in engagement with the engagement portion 6*a* of the front body 6 so as to be detachably fixed by way of mutual elastic deformation. In other words, also the engagement portion 6*a* is constituted by a groove and a rib (projection) corresponding to the rib (projection) and the groove of the above-mentioned guide cylinder 5. Fitting the rib (projection) of the guide cylinder 5 into the groove of the front body 6 prevents rotation in the circumference direction, so that the rib of the front body 6 is held in engagement with the groove of the guide cylinder 5, thus preventing their extrusion.

When the rib (projection) of the guide cylinder 5 is fitted in the groove of the front body 6, even if there is some displacement between them in the circumferential direction, the rib is guided by a taper part (not shown) of an edge of an entrance of the groove and a top end shape of a wedge shape of the rib, so that they are reliably fitted to each other. Of course, the engagement between the front body and the guide cylinder may be screw engagement.

The rear body 1 includes a clip 1*b* at an outer perimeter rear end and the cam slope 2 which is integrally formed in the shape of the circumference in an inner hole portion so as to be directed forwardly. A cut-out 2*a* is provided in the forefront end of the cam slope 2. In addition, the cam slope 2 may be fixed in the inner hole portion of the rear body as a separate cylindrical cam.

Further, a projecting portion 5*b* of the guide cylinder is fitted in a recessed groove 1*a* provided in a front inner hole portion of the rear body 1 by way of mutual elastic deformation, so that the guide cylinder 5 is fixed and prevented from extruding so as to be rotatable with respect to the rear body 1.

On the other hand, the ball-point pen refills 13 and 14 are removably fitted in knock cylinders 11 and 12, and the slide members 7 and 8 are fixed to the rear ends of the knock cylinders 11 and 12, which will be described in further detail.

Further, return springs 19 and 19 are provided respectively between the slide members 7 and 8 and front end step portions of the guide groove 5*c* and 5*d* of the guide cylinder 5, so that the ball-point pen refills 13 and 14 are biased backwards along the body.

Therefore, the rear body 1 is rotated with respect to the front body 6, so as to cause each of the slide members 7 and 8 to slide on the cam slope 2. In conjunction with this, the ball-point pen refills 13 and 14 are allowed to move back and forth.

The knock bar 3 includes a cylindrical knock portion provided behind a flange part 3*a* and a knock piece 3*b* formed on one side of the flange part 3*a* so as to project forward. An engagement portion 3*c* in the shape of a cut-out is suitably provided at the front end of the above-mentioned knock piece 3*b*.

Further, the knock spring 20 is provided between a step portion 2*b* disposed behind the inner hole portion of the rear body 1 and a front end of the flange part 3*a* of the knock bar.

An end stopper 4 is fixed to the rear end of the inner hole of the rear body 1 such that a front end of the end stopper is in abutted contact with the back end of the flange part 3*a*.

Moreover, the knock bar 3 is arranged to be able to move back and forth integrally in the direction of rotation with respect to the rear body 1. Furthermore, the cut-out 2*a* of the above-mentioned cam slope and the knock piece 3*b* are provided on the same line.

Figure 3:
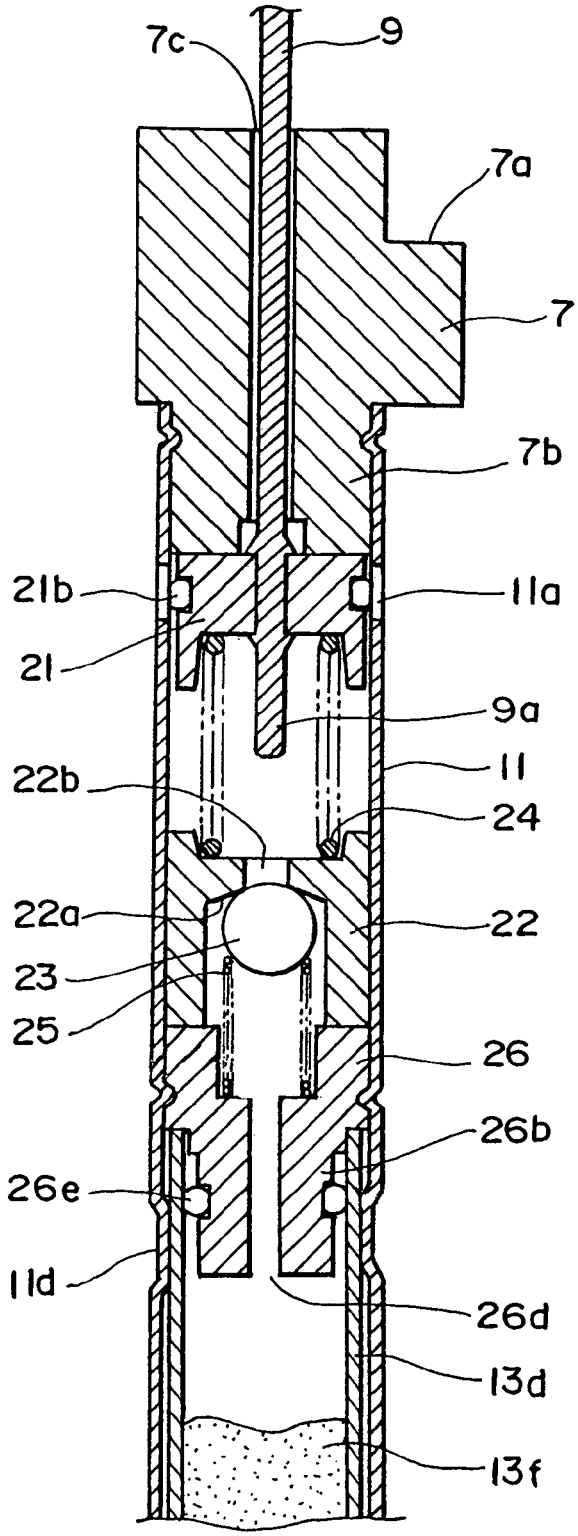
FIG. 3 is a partially enlarged sectional view of a pressurization mechanism portion corresponding to a state of FIG. 1.

Next, with reference to FIGS. 3 and 4 the main part of the pressurization mechanism portion will be described further.

As shown in the figures, a shaft part 7*b* of the slide member 7 is fixed to the rear end of the inner hole of the knock cylinder 11 by way of press fit, crimp, etc.

When the composite writing instrument is desired to be as thin as possible, a thin metallic pipe is used for the knock cylinder 11. A through hole 7*c* in which a knock pin 9 is inserted freely is provided in the axial center of the slide member 7. A projection 7*a* which is in sliding contact with the cam slope is formed in the outer perimeter part.

Further, a piston 21 is disposed such that its back end is in abutted contact with the front end of the shaft part 7*b* of the slide member. The front part of the knock pin 9 is fixed in the axial center of the above-mentioned piston 21 by way of press fit or crimp. Further, the above-mentioned knock pin 9 is fixed to the front end of the piston 21 so as to project suitably. In other words, a projecting part 9*a* projecting from the front end of the piston 21 is formed. The rear of the above-mentioned knock pin 9 passes through the through hole 7*c* of the slide member, leaving a suitable length of the knock pin extruded out of the rear end of the slide member.

A seal ring 21*b* made of an elastic body, such as rubber, is provided in an outer perimeter part of the piston 21. In a situation where the back end of the piston 21 is in abutted contact with the front end of the slide member 7, the seal ring 21*b* is located in a through hole 11*a* provided in a desired position at the periphery of the knock cylinder 11, so that the inner hole portion in front of the piston is communicated with open air outside the knock cylinder 11.

Further, a space part is suitably provided in front of the above-mentioned piston 21 so that a bush 22 is fixed to inner hole portion of the knock cylinder 11. A knock spring 24 is provided between the front end of the piston 21 and the rear end of the bush 22 so that the piston 21 is always biased backwards.

Further, the bush 22 has a vent 22*b* formed at the rear end axial center and a taper-like holder seat 22*a* formed in front of the vent.

A fixed shaft 26 having formed therein a through hole 26*d* at the axial center part is air-tightly fixed to the inner circumference of the knock cylinder 11 by way of press fit, crimp, etc. in a situation where the rear end of the fixed shaft is in abutted contact with the front end of the above-mentioned bush 22.

Further, a spring 25 is provided between the valve 23 and the fixed shaft 26 such that a valve 23 is pressed and in intimate contact with the above-mentioned holder seat 22*a*.

Furthermore, a seal ring 26*e* made of an elastic body, such as rubber, is provided at an outer perimeter part of a shaft part 26*b* of the tip end of the fixed shaft 26. When an ink accommodation pipe 13*d* of the ball-point pen refill is equipped through the front end of the inner hole portion of the above-mentioned knock cylinder 11, the outer perimeter part of the seal ring 26*e* is airtightly in intimate contact with an inner perimeter part of the ink accommodation pipe 13*d*.

Further, an engagement portion 11*d* protruding inside is formed in a desired position in the outer perimeter part of the knock cylinder 11 so that the ink accommodation pipe 13*d* can be held with respect to the pressure by pumping.

The structures of the slide member 7 and the knock cylinder 11 have been described above. Since structures of the other slide member 8 and the knock cylinder 12 are also the same, detailed description of the slide member 8 and the knock cylinder 12 will not be repeated.

Next, an assembly of the composite writing instrument will be described. Firstly, the ball-point pen refills 13 and 14 are mounted in the composite writing instrument. The front body 6 is detachably fixed to the cylinder part 5*e* of the guide cylinder 5.

The above-mentioned ball-point pen refills 13 and 14 are fixed such that rear ends of the ink accommodation pipes 13*d* and 14*d* are intimately fitted to the front end of the fixed shaft 26.

Then, as shown in FIG. 1 the return spring 19 is provided between a front step portion of the front end of the slide member 8, and the front end step portion of 5*d* of the guide groove of the guide cylinder, so that the ball-point pen refill 14 is biased backwards along the rear body 1.

On the other hand, the ball-point pen refill 13 is such that the projection 7*a* of the slide member 7 is held in engagement with the cut-out 2*a* of the front end of the cam slope 2 and the tip portion of a tip 13*a* projects from the top end hole of the front body 6.

Further, as shown in FIG. 2, a step portion 11*c* of the front end of the knock cylinder 11 is in substantially abutted contact with an inner step portion 6*b* of the front body 6.

In addition, although in the above-mentioned preferred embodiment the step portion 11*c* of the front end of the knock cylinder 11 is brought into contact with the inner step portion 6*b* of the front body 6, the knock cylinder 11 may be reduced in overall length so as to be in contact with the front end portion of the guide cylinder, for example. Further, the front end of the ball-point pen refill may be in contact with the inner step portion of the front body.

Next, operation of this composite writing instrument will be described. If the knock bar 3 is knocked from the state shown in FIGS. 1 and 3, then the rear end of the knock pin 9 is held in engagement with the engagement portion 3*c* of the knock piece 3*b*.

On the other hand, as described above, the step portion 11*c* of the front end of the knock cylinder 11 is brought into substantially abutted contact with the inner step portion 6*b* of the front body 6, which is in the situation where the ball-point pen refill 13 is prevented from advancing (see FIG. 2).

If the knock bar 3 is advanced in this state, the piston 21 moves forward, and the seal ring 21*b* passes beyond the through hole 11*a* of the knock cylinder 11, so that the inside of the knock cylinder is shut off from open air, and the space part in the knock cylinder is compressed.

Figure 4:
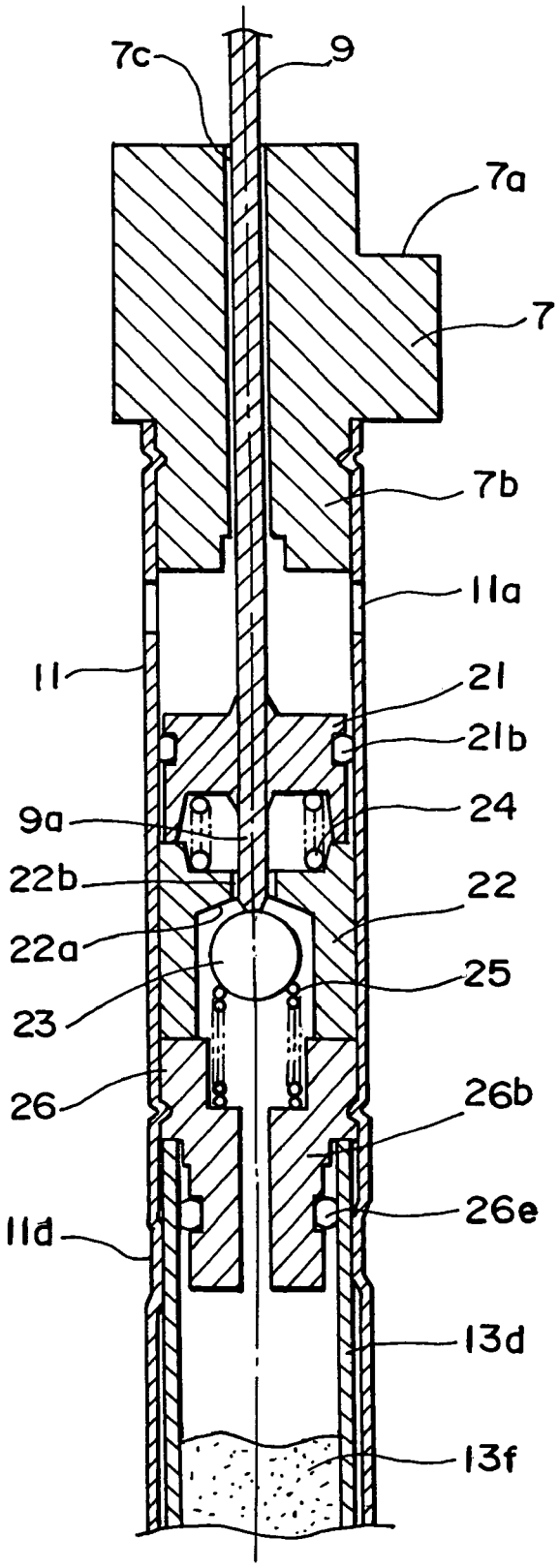
FIG. 4 is a partially enlarged sectional view of the pressurization mechanism portion corresponding to a situation where a knock bar is advanced.

As shown in FIG. 4, as the piston 21 further moves forward, the front end of the projecting part 9*a* of the knock pin 9 is brought into contact with the valve 23, so that the close contact between the valve 23 and the holder seat 22*a* is released and the compressed air is pushed forward (into the ink accommodation pipe 13*d*).

Thus, a rear end of a follower 13*f* is pressed, to thereby help the ink flow toward the tip side. In other words, the rear end of the follower 13*f* is pressed so that the ink flow towards the tip side is improved.

As a result, there are provided operation of preventing the ink from separating from the periphery of the top end ball and the continuous ink flow from being disrupted due to a dropping impact, the poor flowability of the ink, etc., and operation of recovering the ink when disrupted.

Further, if the advance of the knock bar 3 is canceled in the state shown in FIG. 4, the piston 21 retreats and the projecting part 9*a* is detached from the valve 23, so that the valve 23 is in intimate contact with the holder seat 22*a*.

Then, the piston 21 retreats in the situation where the rear end of the follower 13*f* is not depressurized, and returns to the state of FIG. 3 again, whereby the space part is communicated with open air.

Thus, the pumping type pressurization mechanism is arranged such that the front end of the projecting part 9*a* of the knock pin 9 is in contact with valve 23 so that the intimate contact between the valve 23 and the holder seat 22*a* may be canceled, whereby opening/closing operation of the valve can be made reliable.

Further, after the piston 21 retreats and the projecting part 9*a* is detached from the valve 23, and the valve 23 is in intimate contact with the holder seat 22*a*, then the piston 21 returns to an initial state, so that the inside of the once pressurized refill is not depressurized, whereby a disadvantage that the recovery of the ink disruption and the pressurization performance are spoiled can be prevented.

In addition, although the seal ring 21*b* and the piston 21 which are separately formed are used in the above-mentioned example, the above-mentioned seal ring 21*b* can be formed integrally with the piston 21.

However, in view of accuracy of dimension or performance, forming them separately from elastic bodies (such as rubber), elastic molding resins, etc., selecting one that has good sealing performance, and a good sliding effect, interposing a lubricant, etc. should be considered.

Further, in the above-mentioned example, the rotating type composite writing instrument is shown in which the projection 7*a* of the slide member 7 is brought into sliding contact with the cam slope 2 and the slide member 7 is provided to move back and forth by way of rotation of the rear body 1 with respect to the guide cylinder 5.

However, it may be a so-called slider-type composite writing instrument in which the projection of the slide member is exposed from a slit part provided in the periphery of the rear body 1 along the axis direction, so that the projection may be slid with a finger and held in engagement in a front or retreated position.

Further, in the above-mentioned example the projecting part 9*a* is provided to project in front of the piston 21, so that the front end of projecting part 9*a* may be brought into contact with the rear end of the valve 23. However, naturally, the projecting part can be formed integrally with the rear end of the valve.

Next, a structure of a ball-point pen refill used suitably for the pumping type pressurization mechanism will be described with reference to FIGS. 5 through 7.

Figure 5:
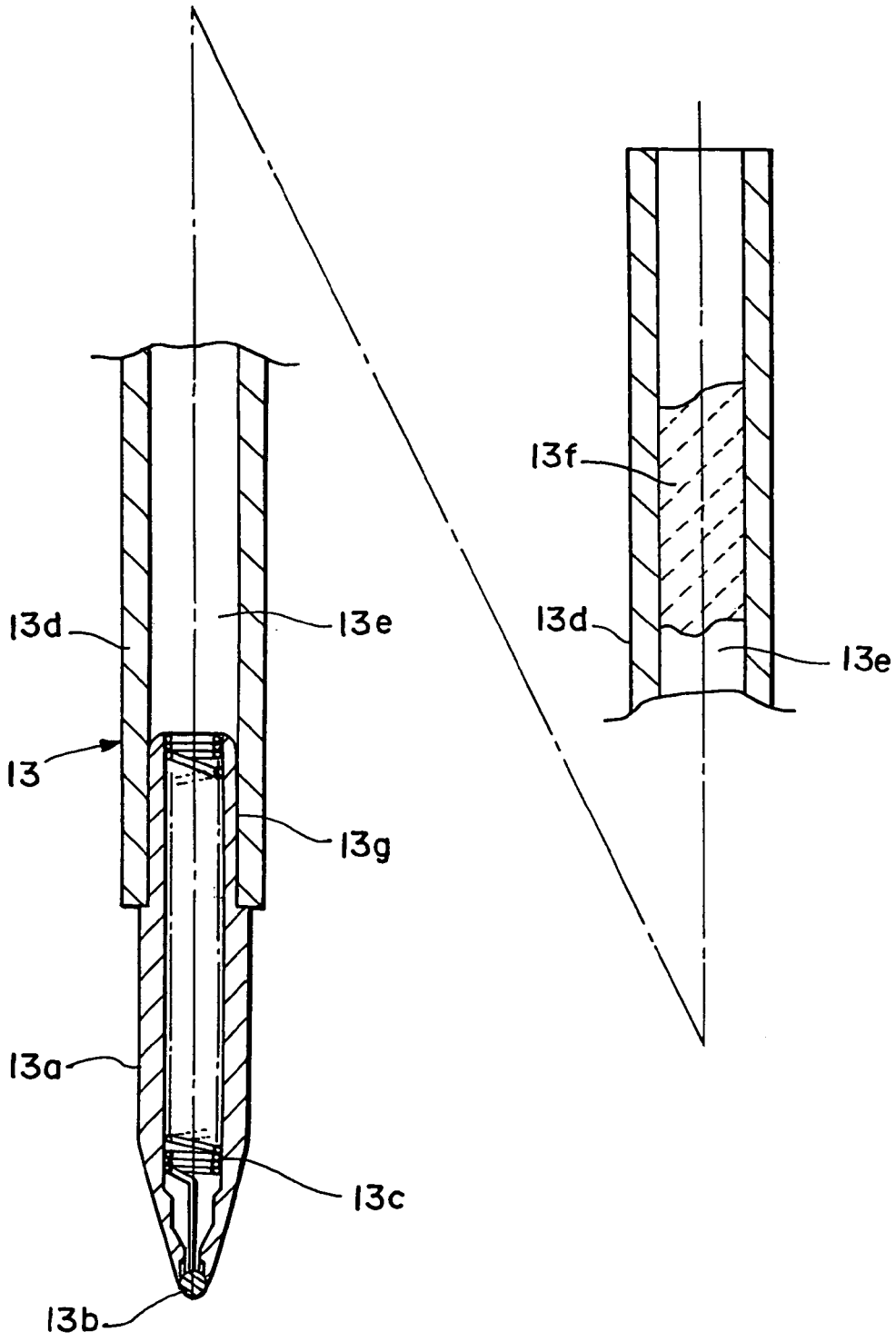
FIG. 5 is a longitudinal sectional view of a ball-point pen refill.

Firstly, a structure of the ball-point pen refill 13 as shown in FIG. 5 will be described. In the situation where a top end ball 13*b* is in substantially abutted contact with the seat having a channel into which the ink can flow, the tip 13*a* is crimped so that the top end ball may be rotatably held.

Further, a spring 13*c* is inserted into an inner hole portion of the tip 13*a*, and the rear end of a shaft part 13*g* of the tip is crimped suitably, so that the rear end of the spring 13*c* is arranged not to be extruded. A perpendicular bar body part is formed at the other end of this spring 13*c*. A top end of this bar body part is pressed into contact with the rear of the top end ball 13*b*.

Further, the shaft part 13*g* of the tip is closely fitted into the ink accommodation pipe 13*d*. Furthermore, a grease-like follower 13*f* is provided at the rear end of an ink 13*e*.

In addition, the top end ball is in intimate contact with the inner edge of the ball holding part of the tip 13*a* by way of the pressure.

Figure 6:
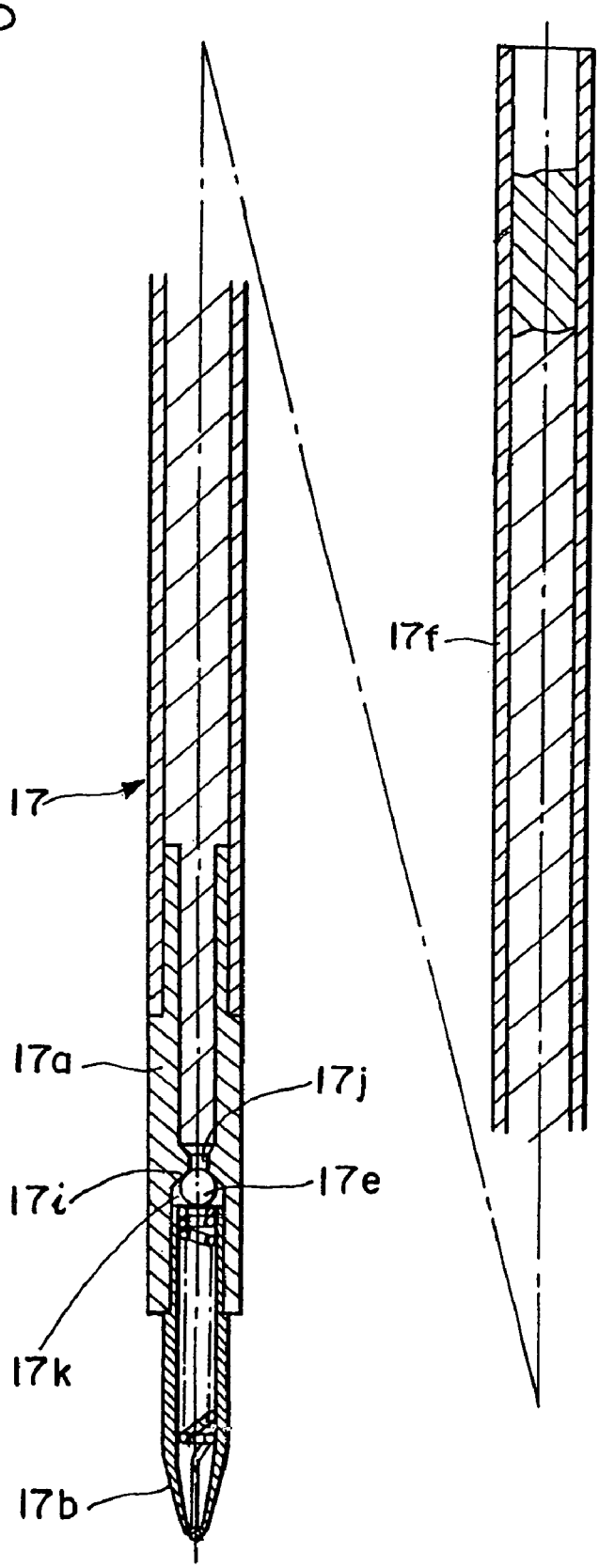
FIG. 6 is a longitudinal sectional view showing another preferred embodiment of the ball-point pen refill.

Next, another preferred embodiment of a ball-point pen refill as shown in FIG. 6 will be described.

This ball-point pen refill 17 is provided with a valve chest 17*k* which is suitably eccentric to an axial center of a tip 17*b* behind an inner hole portion of a joint 17*a*. A taper-like or sphere-shaped ball holder seat 17*i* and a passage hole 17*j* which is communicated with an ink accommodation pipe 17*f* are formed in the rear of this valve chest 17*k*.

Further, a groove part into which an ink can flow is formed on one side of the wall of the valve chest 17*k*. A ball-like valve 17*e* is loosely fitted in the valve chest. Directing the tip downwards, the valve 17*e* is displaced to be into contact with the rear end of the shaft part of the tip, so that ink may flow into the hole portion of the tip through the passage hole 17*j* and through groove part, etc.

Figure 7:
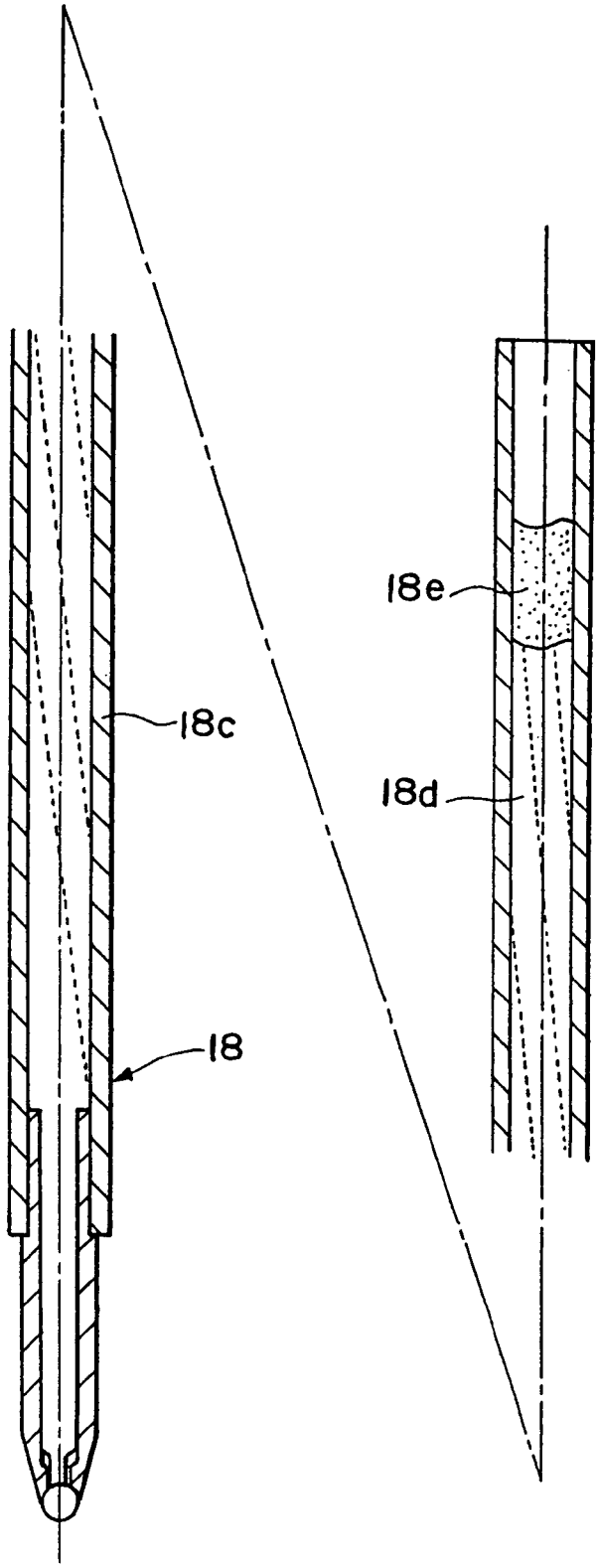
FIG. 7 is a longitudinal sectional view showing still another preferred embodiment of the ball-point pen refill.

Furthermore, a ball-point pen refill as shown in FIG. 7 illustrates another preferred embodiment. This ball-point pen refill 18 is filled up with an oil-based ink 18*d* having a high viscosity. Further, when an ink accommodation pipe 18*c* is thin, a follower 18*e* does not need to be provided.

SECOND EXAMPLE OF THE INVENTION

Next, FIGS. 8 through 13 show the second example of the present invention.

In addition, in these figures, a structure having two ball-point pen refills 13 and 14 is shown. This structure of the ball-point pen refills 13 and 14 is the same as that as described above with reference to FIG. 7. Further, as other ball-point pen refills, those shown in FIGS. 5 and 6 are applicable.

Furthermore, similar to the above-mentioned first example, a composite writing instrument which is an aim of the present invention is characterized by having at least one ball-point pen refill filled up with the ink which receives knock type pressurization operation. As other writing means, it is possible to employ a usual ball-point pen (oil-based) which does not receive pressurization, a ball-point pen carrying a gel ink (water-based or oil-based), a mechanical pencil, etc.

Further, the composite writing instrument of this second example uses a multiple type writing instrument as shown in Patent Document 3, Japanese Laid Open Utility Model No. H01-161081, as an example.

Figure 8:
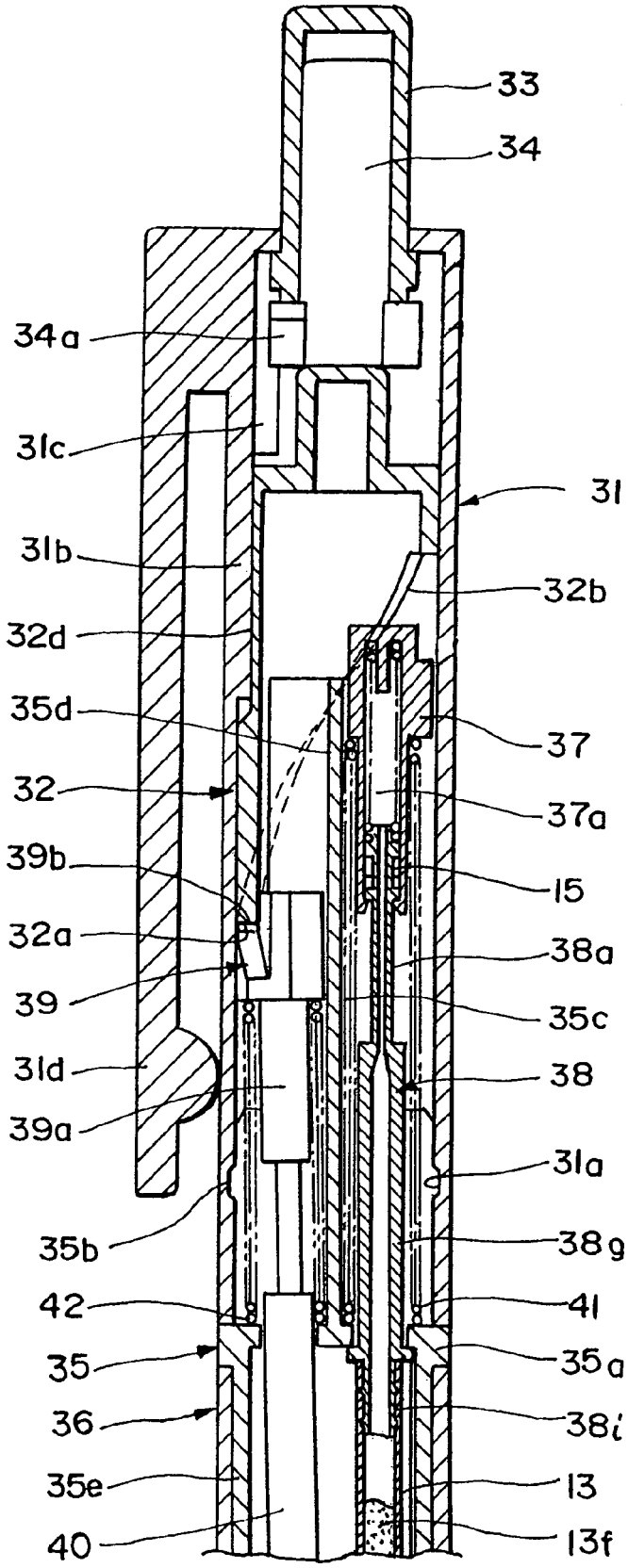
FIG. 8 is a longitudinal sectional view showing the second half part of a composite writing instrument which is a second example of the present invention, where one writing tip portion projects from a top end hole of an front body.
Figure 9:
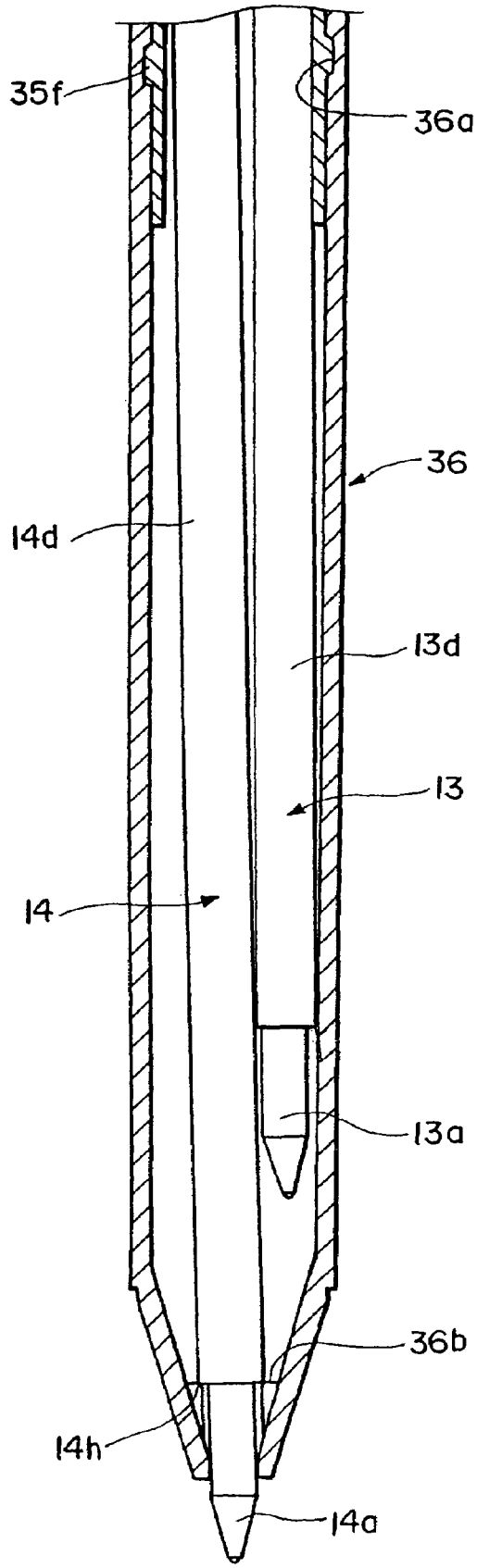
FIG. 9 is a longitudinal sectional view showing the first half part of the composite writing instrument corresponding to FIG. 8.

As shown in FIGS. 8 and 9, this composite writing instrument comprises a guide cylinder 35, an front body 36, a cylindrical cam 32 in which a cam slope 32*b* is formed, a rear body 31 integrally having an internal-tooth part 31*c* at an inner periphery, a pair of slide members 37 and 39, and the ball-point refills 13 and 14, as main elements.

As shown in FIG. 8, the above-mentioned guide cylinder 35 includes a pair of guide grooves 35*c* and 35*d* from the substantially central part to the rear, and further includes a flange part 35*a* in front of which is provided a cylinder part 35*e*. As shown in FIG. 9, on the side of the above-mentioned cylinder part 35*e*, there is provided an engagement portion 35*f* having formed a groove such that part of a rib (projection) and the rib (projection) are partitioned. The whole guide cylinder 35 is integrally molded from a resin.

The above-mentioned guide cylinder 35 is inserted through the rear end opening of the front body 36 into the inside, and causes the engagement portion 35*f* of the guide cylinder 35 to be held in engagement with an engagement portion 36*a* of the front body 36 by way of mutual elastic deformation, so as to be detachably fixed.

In other words, also the engagement portion 36*a* is constituted by a groove and a rib (projection) corresponding to the rib (projection) and the groove of the above-mentioned guide cylinder 35. Fitting the rib (projection) of the guide cylinder 35 into the groove of the front body 36 prevents rotation in the circumference direction, so that the rib of the front body 36 is held in engagement with the groove of the guide cylinder 35 so as to prevent their extrusion.

When the groove of the front body 36 is fitted into the rib (projection) of the guide cylinder 35, even if there is some displacement between them in the circumferential direction, the rib is guided by a taper part (not shown) of an edge of an entrance of the groove and a top end shape of a wedge shape of the rib, so that they are reliably fitted to each other.

The rear body 31 includes a clip 31*d* at an outer perimeter rear end. Further, a recessed groove 31*a* is provided in a front inner hole portion of the rear body 31, and a rib 31*b* is provided in a rear inner hole portion.

Further, the above-mentioned cylindrical cam 32 has a circumference-like cam slope 32*b* which is directed forwardly. A cut-out 32*a* is provided in the forefront end of this cam slope 32*b* and a groove 32*d* is provided on a side.

Further, by way of mutual elastic deformation, a projecting portion 35*b* provided a little behind a flange part 35*a* of the guide cylinder is fitted into the recessed groove 31*a* provided in the front inner hole portion of the rear body 31, so that the guide cylinder 35 can be fixed rotatably with respect to the rear body 31, thus preventing it from extruding.

Further, the rib 31*b* of the rear body 1 is fitted into the groove 32*d* so that the cylindrical cam 32 can rotate integrally with the rear body and move independently in the axis direction.

Therefore, this cylindrical cam 32 is arranged to move in the axis direction with respect to the guide cylinder 35 and arranged to rotate with respect to the guide cylinder 35.

On the other hand, the rear ends of the ball-point refills 13 and 14 are detachably fitted to front ends of pressurization shafts 38 and 40, which will be described in detail later. The slide members 37 and 39 are provided at the rear ends of the pressurization shafts 38 and 40. Further, return springs 41 and 42 are provided respectively between the slide members 37 and 39 and front end step portions of the guide grooves 35*c* and 35*d* of the guide cylinder 35, so that the ball-point refills 13 and 14 are biased backwards.

Therefore, the rear body 31 is rotated with respect to the front body 36, so as to cause each of the slide members to slide on the cam slope 32*b* of the cylindrical cam 32. In conjunction with this, the ball-point pen refills 13 and 14 are allowed to move back and forth.

Further, the internal-tooth part 31*c* is formed in a rear end inner hole portion of the rear body 3. A gear-tooth 34*a* of a rotor 34 engages with a gear tooth of the above-mentioned internal-tooth part 31*c* so that the knock bar 33 is inserted into the above-mentioned rotor 34. The knock bar 33 is caused to project from the rear end of the rear body 31.

By knocking the knock bar 33, the rotor 34 located in front of the knock bar 33 is advanced or retreated. Furthermore, the cylindrical cam 32 located in front of a rotor 34 is advanced or retreated.

In conjunction with this, the writing tip portions of the ball-point refills 13 and 14 can protrude or retreat from the top end hole of the front body 36.

Figure 11:
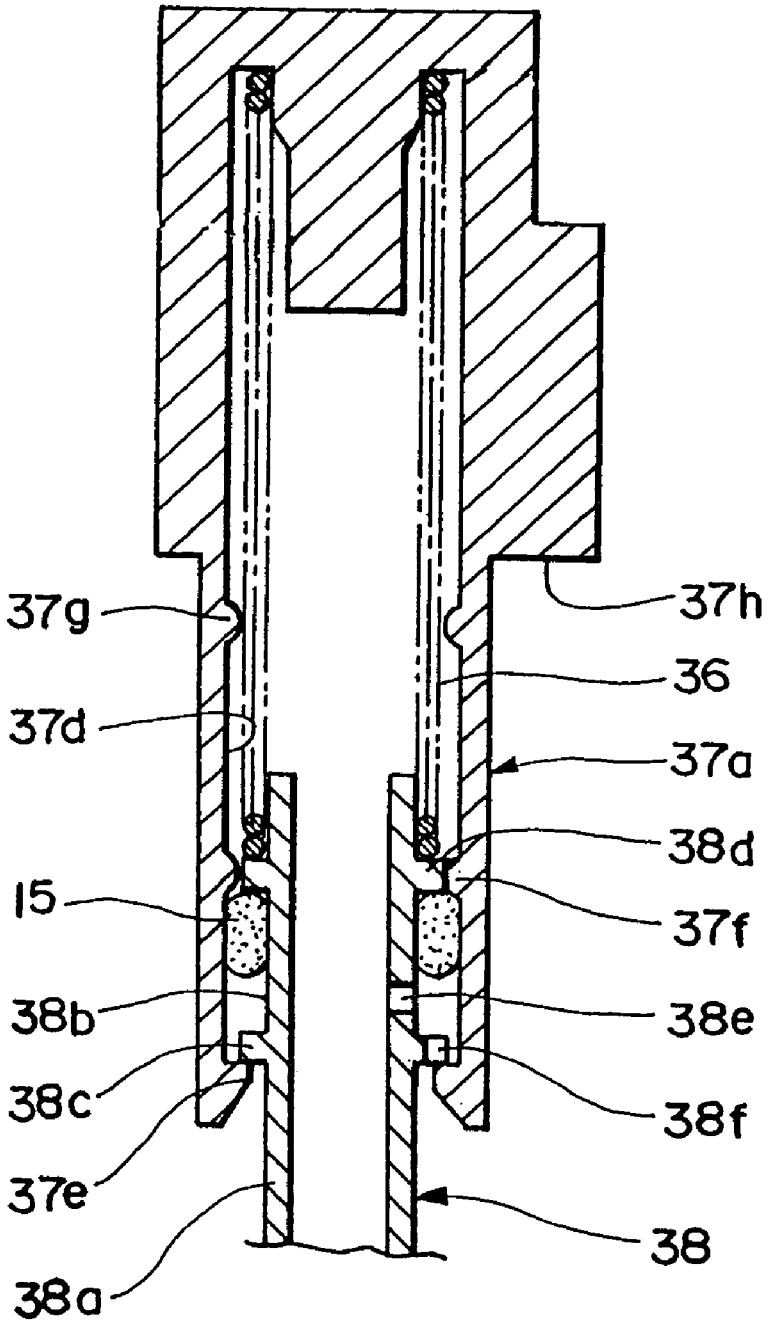
FIG. 11 is a partially enlarged sectional view of the pressurization mechanism portion corresponding to the state of FIG. 8.
Figure 12:
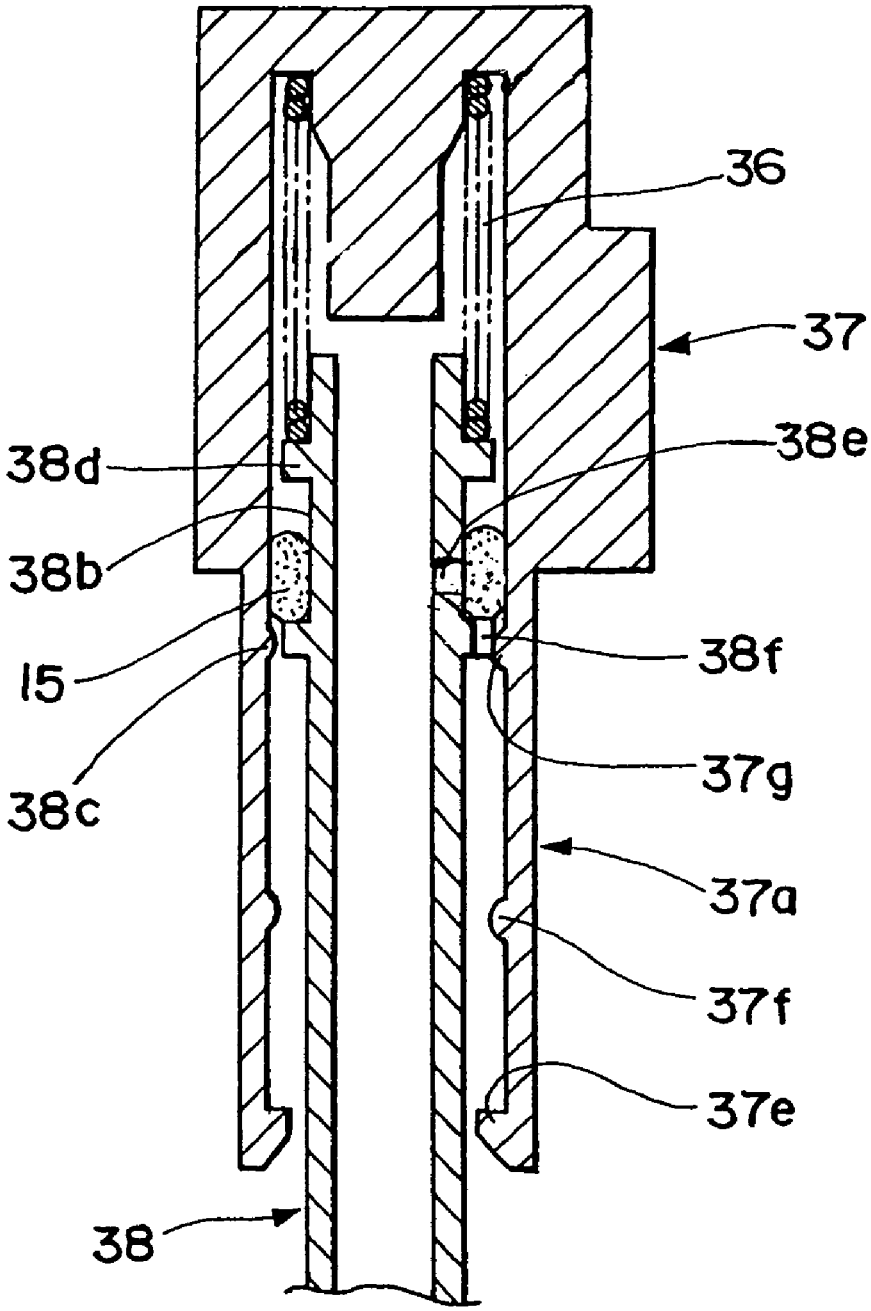
FIG. 12 is a partially enlarged sectional view of the pressurization mechanism portion corresponding to the state of FIG. 10.
Figure 13:
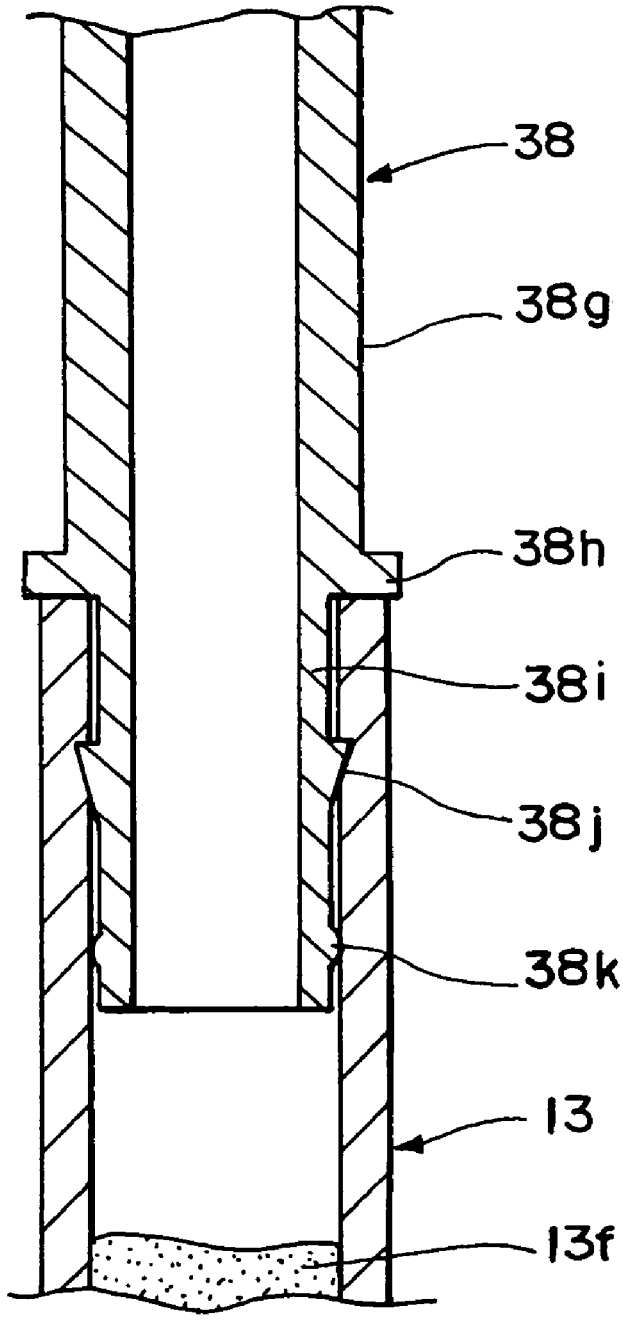
FIG. 13 is a sectional view having enlarged and shown a connection between the pressurization mechanism portion and the ball-point pen refill.

Next, with reference to FIGS. 11, 12, and 13, the main part of a pressurization mechanism portion will be further described. In addition, since the slide member 37 side and the slide member 39 side are the same, the description will be carried out in accordance with the slide member 37 side.

As shown in FIG. 11, in front of the slide member 37 a pressurization cylinder 37*a* is provided integrally therewith. An inner hole of this pressurization cylinder 37*a* is closed at its rear end. By way of a spring 36 in the inner hole, the pressurization cylinder 37*a* is arranged to move back and forth with respect to the pressurization shaft 38.

The pressurization shaft 38 and the pressurization cylinder 37*a* are arranged such that internal air may be compressed when the pressurization cylinder 37*a* slides forward with respect to the pressurization shaft 38, to thereby construct the pressurization mechanism portion.

This pressurization shaft 38 is constituted by a front body portion 38*g* and a rear body portion 38*a*. A front flange portion 38*c* and a rear flange portion 38*d* form therebetween a recessed groove portion 38*b* in the shape of the circumference at the periphery of a substantially rear end of the rear body portion 38*a*. Further, a cut-out groove 38*f* is provided in a desired position of the front flange portion 38*c*.

Further, a small hole 38*e* (air passage) which is communicated with a hole portion bored in a shaft center of the pressurization shaft 38 is provided on the front end side of the recessed groove portion 38*b*. Furthermore, a seal ring 15 made of an elastic body, such as rubber, is closely inserted in the recessed groove portion 38*b*. This seal ring 15 is arranged so as to slide back and forth with respect to the recessed groove portion 38*b*.

Further, as shown in FIG. 13 a flange part 38*h* is provided at the outer perimeter of a substantially front end portion of the front body portion 38*g*. Furthermore, a fixing shaft part 38*i* is provided at the front end of the front body portion 38*g*. A seal part 38*k* which is made into a circumference-like projection is formed in a desired position (one position in the example) of the perimeter of the fixing shaft part 38*i*. When the perimeter of the fixing shaft part 38*i* is equipped with the ball-point pen refill, the seal part 38*k* is brought into intimate contact with an inner surface of the ink accommodation pipe 13 of the refill air-tightly.

Further, a projection-like engagement portion 38*j* is formed at the rear perimeter of the seal part 38*k*, so as to ensure the fixed state between the fixing shaft part 38*i* and the ball-point pen refill.

Furthermore, in the situation where the spring 36 is provided between the rear end of the rear flange portion 38*d* of the pressurization shaft 38 and a closed end portion of the rear end of the inner hole of the pressurization cylinder portion 37*a*, the pressurization shaft 38 is inserted in the inner hole of the pressurization cylinder 37*a*.

The front flange portion 38*c* of the pressurization shaft is elastically engaged with the engagement portion 37*e* formed as an elongated projection or a circumferential projection provided at the periphery of the front end inner hole portion of the above-mentioned pressurization cylinder 37*a*. This pressurization shaft 38 is always biased forward by the force of the spring 36, so as not to be extruded.

Further, the cut-out groove 38*f* provided in a desired position of the outer perimeter of the front flange portion 38*c* allows the front and the rear of the front flange portion 38*c* to be vented to the outside of the pressurization cylinder 37*a*. In addition, the means for holding the pressurization cylinder 37*a* in engagement with the pressurization shaft 38 and the ventilation means for allowing the front and the rear of the front flange portion to be vented to the outside of the pressurization cylinder by the cut-out groove are not limited to the above preferred embodiments.

Furthermore, at the periphery of the inner hole portion of the pressurization cylinder 37*a*, an engagement portion 37*f* which is an elongated projection or a circumferential projection is provided suitably behind the above-mentioned engagement portion 37*e*. Furthermore, a rear engagement portion 37*g* is similarly provided behind the engagement portion 37*f*.

As shown in FIG. 11 the seal ring 15 is close to the rear end side of recessed groove portion 38*b*. The above-mentioned engagement portion 37*f* is located to be substantially in contact with an edge of the rear end side of the seal ring 15.

When the slide member 37, i.e., the pressurization cylinder 37*a* moves forward with respect to the pressurization shaft 38, the engagement portion 37*f* pushes the edge of the rear end side of the seal ring 15 so as to urge the seal ring 15 towards the front end side in the recessed groove portion 38*b*, whereby the small hole 38*e* (air passage) is closed.

As the pressurization cylinder 37*a* further advances, the engagement portion 37*f* moves beyond the outer perimeter part of the seal ring 15, and the outer perimeter part of the seal ring 15 slides in close contact with an inner periphery 37*d* of the inner hole of the pressurization cylinder 37*a*, so that the air in the pressurization cylinder 37*a* is compressed into the inner hole of the shaft center of the pressurization shaft 38 (see FIG. 12).

Further, when the pressurization cylinder 37*a* retreats from the state where it has moved forward with respect to the pressurization shaft 38, the engagement portion 37*g* is brought into contact with the seal ring 15, and the seal ring 15 is moved close to the rear end side in the recessed groove portion 38*b*, so that the air passage is opened. In other words, it can retreat in the situation where the inside of the pressurization cylinder is communicated with open air.

However, strictly, the engagement portion 37*g* is brought into contact with the seal ring 15, the sliding causes the pressure to decrease from then until the seal ring 15 approaches the rear end side of the recessed groove portion 38*b* so as to open the small hole 38*e*.

The seal ring 15 is made of an elastic body, such as rubber, or an elastic molding resin, etc., which is selected in view of good sealing performance, and a good sliding effect, and interposing a lubricant, etc. should be considered.

Next, the assembly of this composite writing instrument will be described. Firstly, as shown in FIGS. 8 and 9, the composite writing instrument is equipped with the ball-point pen refills 13 and 14, and the front body 36 is detachably fixed to the cylinder part 35*e* of the guide cylinder 35.

Further, as shown in FIG. 13 the above-mentioned ball-point pen refills 13 and 14 are fixed such that the rear ends of the ink accommodation pipes 13*d* and 14*d* are closely fitted to the fixing shaft parts 38*i* of the pressurization shafts 38.

As shown in FIG. 8, a return spring 41 is provided between a front step portion 37*h* of the slide member 37, and a front end step portion of the guide groove 35*c* of the guide cylinder, so that the ball-point pen refill 13 is biased towards the rear of the rear body 31.

A return spring 42 is provided between a front step portion of the front end of the slide member 8, and a front end step portion of the guide groove 5*d* of the guide cylinder, so that the ball-point refill 14 is biased towards the rear of the rear body 1.

On the other hand the ball-point refill 14 is such that a projection 39*b* of the slide member 39 is held in engagement with the cut-out 32*a* of the front end of the cylindrical cam 32 and a tip portion of a tip 14*a* projects from the front end hole of the front body 36. Further, a step portion 14*h* of the front end of the ink accommodation pipe 14*d* is brought substantially into contact with an inner step portion 36*b* of the front body 36.

Further, in the situation where the projection of the slide member and the cut-out of the cylindrical cam are disengaged, the tip end portion is accommodated in the front body so as to be in a situation where it is held or carried.

In addition, in the above-mentioned examples, when the knock bar 33 is knocked and the cylindrical cam 32 is held in engagement and in an advanced state, it is desirable that the cylindrical cam 32 is fixed so as not to further rotate in a rotating direction with respect to the guide cylinder 35. Providing a fixing means (not shown) in this way can prevent the slide member etc. from being damaged.

Further, the biasing force of the spring 36 used for the above-mentioned pressurization mechanism portion is suitably set to a biasing force greater than that of the return spring 41, so that the spring 36 is set as a relationship in which it is not substantially displaced by way of compression until the writing tip portion is held in engagement and in a situation where it projects from the top end hole of the front body. As shown in FIG. 11 the inside of the pressurization cylinder is communicated with open air.

Next, operation of the pumping type pressurization mechanism used for this composite writing instrument will be described. As the knock bar 33 is knocked from the state shown in FIG. 8, the cylindrical cam 32 is held in engagement and in the advanced state shown in FIG. 10, and the slide member 39 is in the advance state.

In addition, since the slide member 37 side and the slide member 39 side have the same structure, operation on the slide member 39 side will be described hereafter.

In other words, in a situation where the ball-point pen refill 14 is prevented from advancing, the pressurization cylinder 39*a* moves forward with respect to the pressurization shaft 40. Immediately after the pressurization cylinder 39*a* has suitably advanced, the seal ring 15 closes the small hole 38*e* of the pressurization shaft 40 so that the inside of the pressurization cylinder is shut off from open air.

After that, the space part in the pressurization cylinder is compressed so that the air is compressed forward, and the rear end of the follower is pressurized so as to help the ink flow towards the tip side (see FIG. 12).

As a result, there are provided operation of preventing the ink from separating from the periphery of the top end ball and the continuous ink flow from being disrupted due to a dropping impact, the poor flowability of the ink, etc., and operation of recovering the ink when disrupted.

Figure 10:
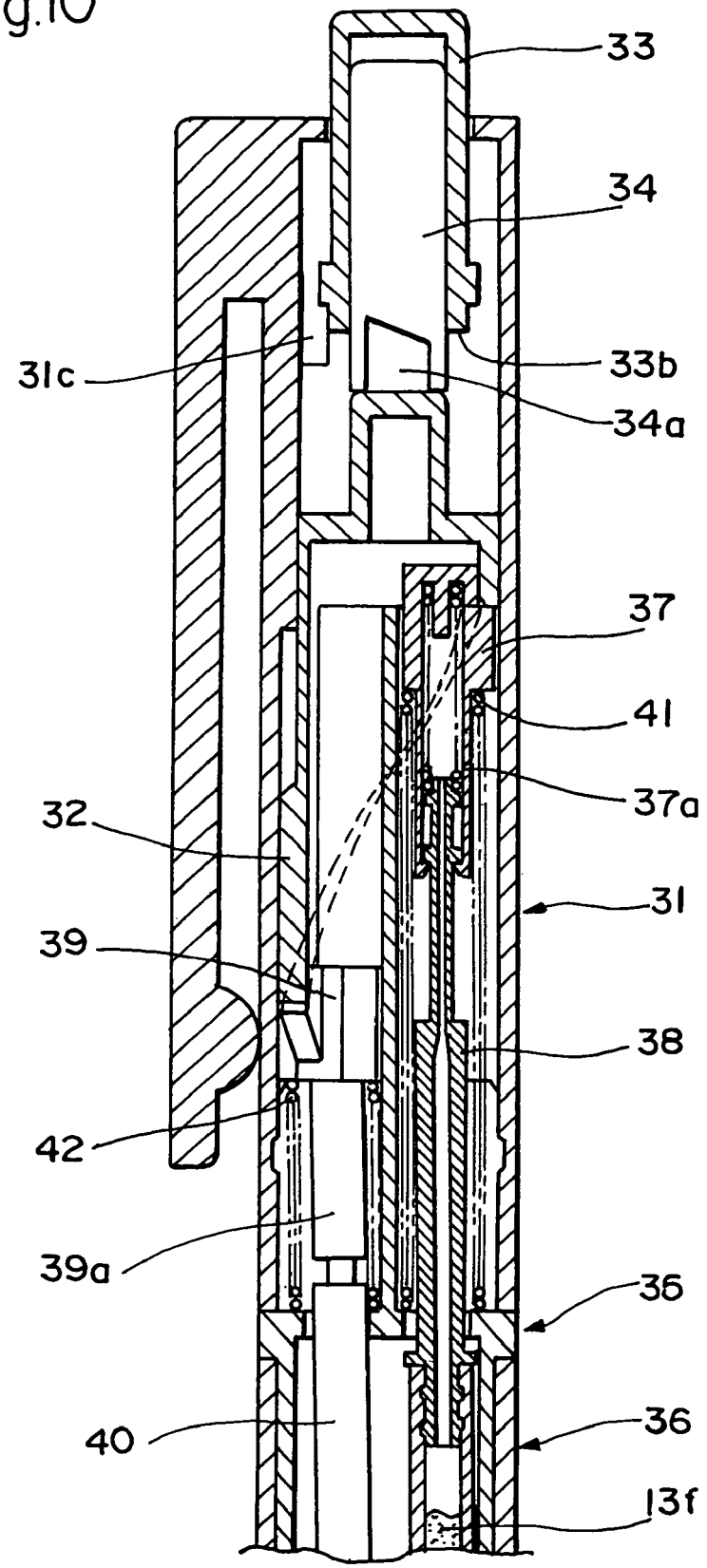
FIG. 10 is a longitudinal sectional view showing the second half part of the composite writing instrument in which the knock bar is knocked in the state of FIG. 8 such that a projecting ball-point pen is in a pressed state.

Further, when the knock bar 33 is knocked from the state shown in FIG. 10, the cylindrical cam 32 is again held in engagement in the situation where it is retreated as shown in FIG. 8.

In conjunction with this the slide member 39 also retreats, during which the engagement portion 37*g* is substantially in contact with the edge on the front end side of the seal ring 15 as illustrated in FIG. 12. As the slide member 39 retreats, the pressurization cylinder 37*a* retreats.

As the pressurization cylinder 37*a* retreats, the engagement portion 37*g* urges the seal ring 15 to move towards the rear end of the recessed groove portion 38*b* of the pressurization shaft 40 so as to open the small hole 38*e*, whereby the inside of the pressurization cylinder is communicated with open air.

Thus, in the pumping type pressurization mechanism, the small holes 38*f* and 38*e* are opened and closed by the seal ring 15, so that opening/closing operation of the valve can be made reliable.

Further, when pressurization cylinder 37*a* retreats, the engagement portion 37*g* urges the seal ring 15 to move towards the rear end of the recessed groove portion 38*b* of the pressurization shaft 40 so as to open the small hole 38*e*, so that the inside of the pressurization cylinder is communicated with open air. Therefore, the inside of the once pressurized refill is not depressurized, and a disadvantage that the recovery of the ink disruption and the pressurization performance are spoiled can be prevented.

In addition, in the above-mentioned preferred embodiment, although the case has been described where the engagement portion 37*f* and the engagement portion 37*g* are provided in the inner periphery 37*d* of the pressurization cylinder 37*a*, the engagement portion 37*f* or the engagement portion 37*g* may not necessarily be provided in the inner periphery 37*d* of the pressurization cylinder 37*a*, when friction resistance between the inner periphery of the seal ring 15 and the periphery of the recessed groove portion 38*b* of the pressurization shaft 38 is set to friction resistance smaller than that between the inner periphery of the inner hole of the pressurization cylinder 37*a* and the outer perimeter of the seal ring 15.

Further, in order to put the seal ring 15 in such conditions, an infinite number of small and uneven portions are formed in the general shape of circumference in the inner periphery of the seal ring 15. Furthermore, a material with a small coefficient of friction may be chosen for the pressurization shaft or the recessed groove portion, the outside of the seal ring may be made soft and the inside may be made hard so as to have a two-layer structure, the inside of the seal ring or the periphery of the recessed groove portion may be treated so as to reduce the friction resistance, etc.

Basically, the seal ring may loosely be fitted to the groove part, except that the seal ring has approached the front end side of the recessed groove portion (the small hole is closed).

However, including the causes, such as deviations in components, when the friction resistance between the inner periphery of the seal ring 15 and the periphery of the recessed groove portion 38*b* of the pressurization shaft 38 has become larger than the friction resistance between the inner periphery of the inner hole of the pressurization cylinder 37*a* and the outer perimeter of the seal ring 15, it is necessary to provide the engagement portion 37*f* and the engagement portion 37*g* in the inner periphery 37*d* of the pressurization cylinder 37*a*, as described above.

When the engagement portions are provided, compared with the maximum value of the friction resistance between the inner periphery of the seal ring 15 for opening or closing the small hole 38*e* and the periphery of the recessed groove portion 38*b* of the pressurization shaft, a larger force may only be provided which engages the engagement portion 37*f* or the engagement portion 37*g* with the edge of the end portion of the seal ring 15. A projecting portion of the actual engagement portion is minute and also small as compared with the close contact area of the seal ring, and therefore does not affect the close contact with the seal ring, whereby it can move beyond the outer perimeter.

THIRD EXAMPLE OF THE INVENTION

Next, FIGS. 14 through 19 show a third example of the present invention.

Figure 14:
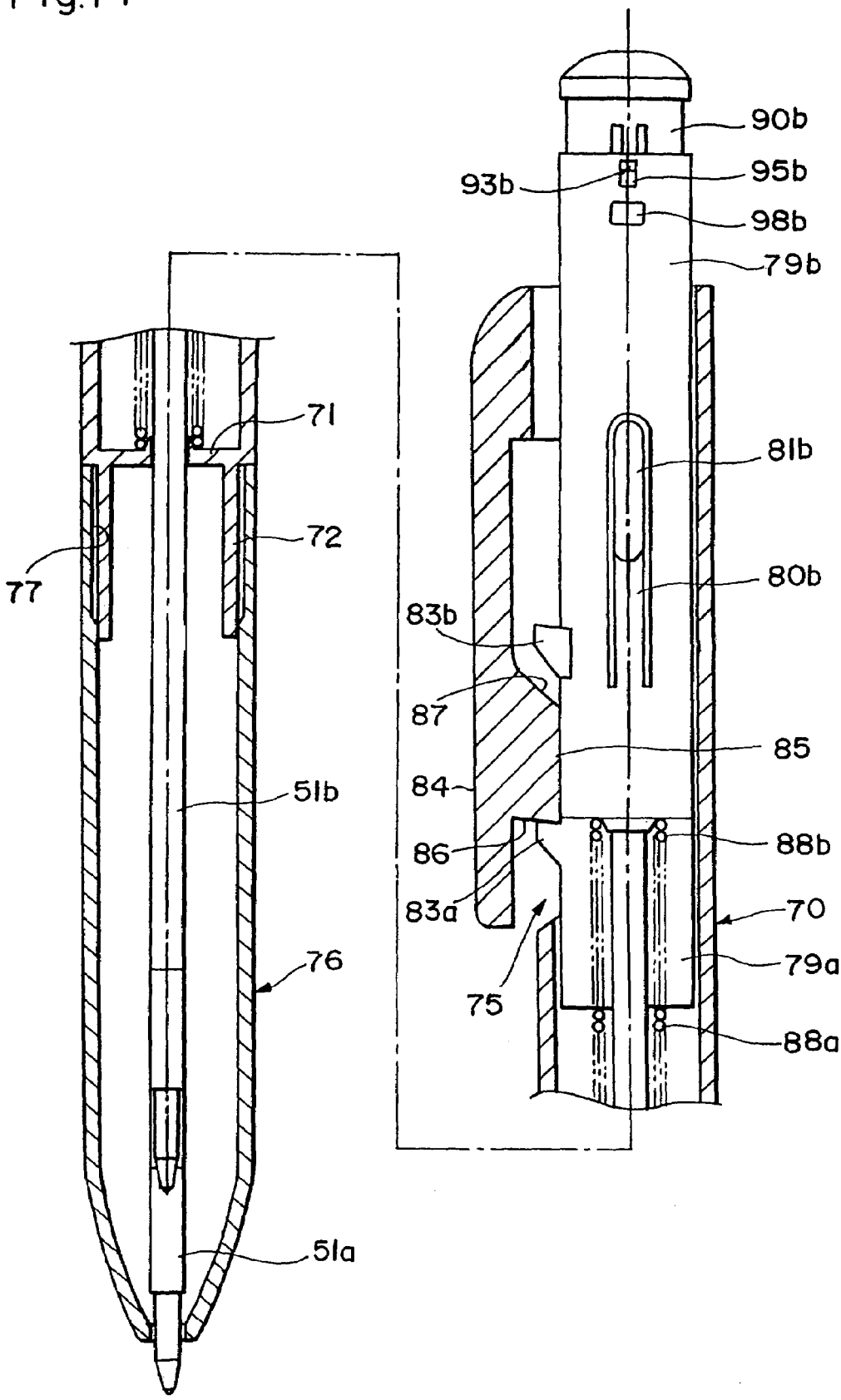
FIG. 14 is a front side fragmentary longitudinal sectional view of the composite writing instrument which is a third example of the present invention, and shows a situation where one writing tip projects.

As shown in FIG. 14, a body cylinder is arranged such that a male screw 72 is provided in a front end of a rear body 70, and a female screw 77 is provided in a rear end hole of a front body 76, so that both the screws are detachably in screw engagement with each other.

Further, a partition part 71 is provided at the rear end of the male screw 72 of the rear body 70. The partition part 71 is provided with holes through which ball-point pen refills 51*a* and 51*b* pass, and seat portions with which front ends of return springs 88*a* and 88*b* to be mentioned later are brought in contact.

Further, a clip 84 is formed in a rear body side of the rear body 70. An aperture part 75 in the axis direction is bored in a body side facing the clip 84.

Figure 15:
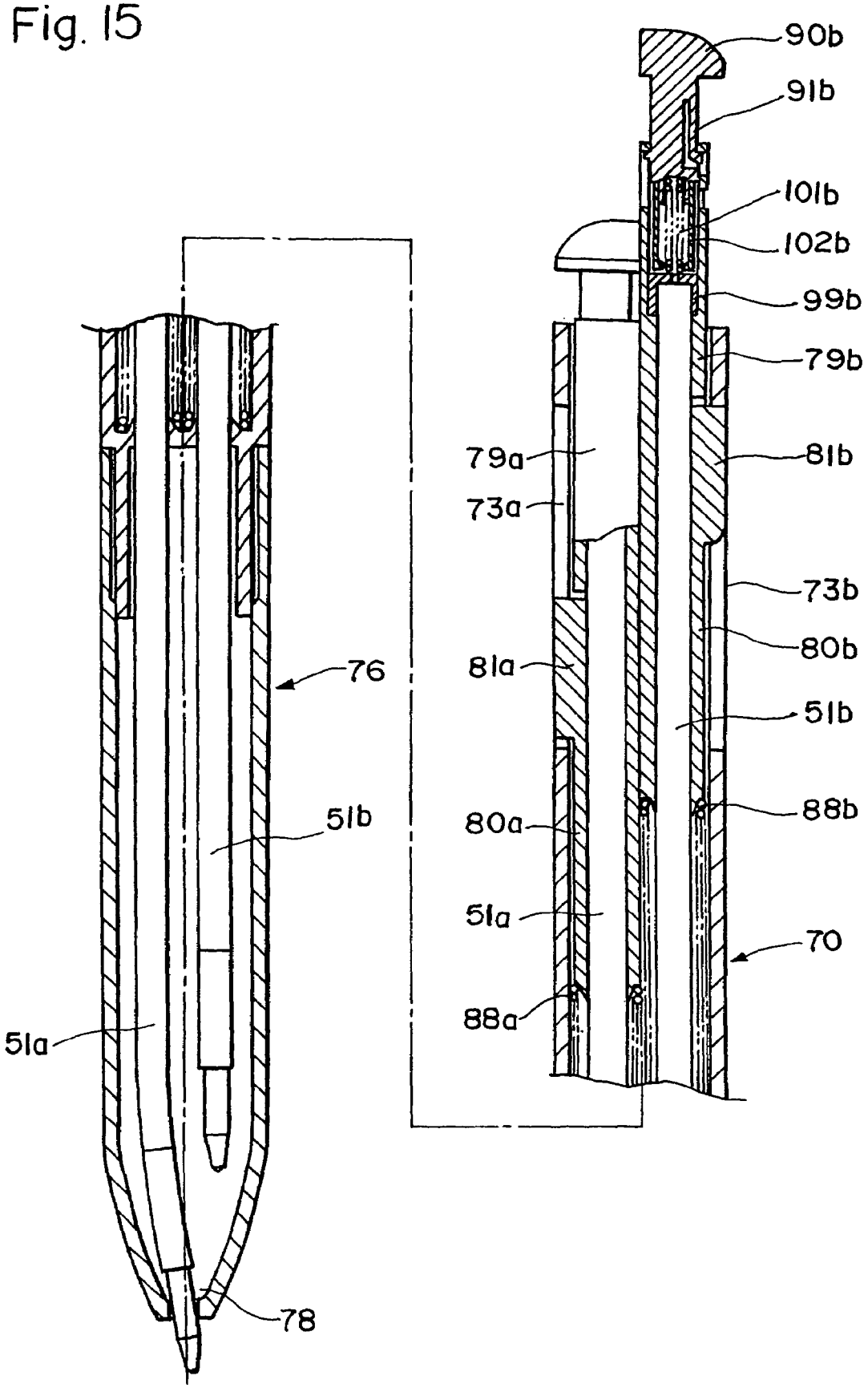
FIG. 15 is a fragmentary longitudinal sectional view from above.

Furthermore, as shown in FIG. 15, slits 73*a* and 73*b* are pierced in both the body sides of the rear body 70 which are perpendicular to the clip 84.

Moreover, a ball part 85 is formed in a tip portion of the clip 84. A hook-like engagement step portion 86 is provided in the front side of the ball part 85. Further, a rear end portion 87 having a suitable slope is provided at the rear end of the ball part 85.

On the other hand, as shown in FIGS. 14 and 15 knock bodies 79*a* and 79*b* have, in the shaft center part, hole portions in which the ball-point pen refills 51*a* and 51*b* are detachably fitted. Cut-out grooves are provided on the respective sides, so that elastic pieces 80*a* and 80*b* capable of being displaced are provided. Guide projecting portions 81*a* and 81*b* are formed in the rear of the elastic pieces. These guide projecting portions 81*a* and 81*b* are fitted in the slits 73*a* and 73*b* so as to move therein in the axis direction.

Furthermore, engagement projections 83*a* and 83*b* are provided on the sides perpendicular to the guide projecting portions 81*a* and 81*b*.

The rear end portions of the respective ball-point pen refills 51*a* and 51*b* are fitted in the above-mentioned knock bodies 79*a* and 79*b*. In the situation where the return springs 88*a* and 88*b* have been fixed through the ball-point pen refills, the knock bodies are inserted through the rear ends of the rear body 70, respectively. When the ball-point pen refills 51*a* and 51*b* are inserted through the holes provided in the partition part 71, the front ends of the return springs are brought into contact with the seat portions provided in the partition part 71.

Further, at this stage, the guide projecting portions 81*a* and 81*b* provided in the knock bodies 79*a* and 79*b* are fitted and held in the slits 73*a* and 73*b* of the rear body by way of elastic deformation. The knock bodies 79*a* and 79*b* are attached to the rear body 70, respectively.

Furthermore, the engagement projections 83*a* and 83*b* are inserted through the aperture part 75 of the rear body.

Next, operation of this composite writing instrument will be described.

Figure 16:
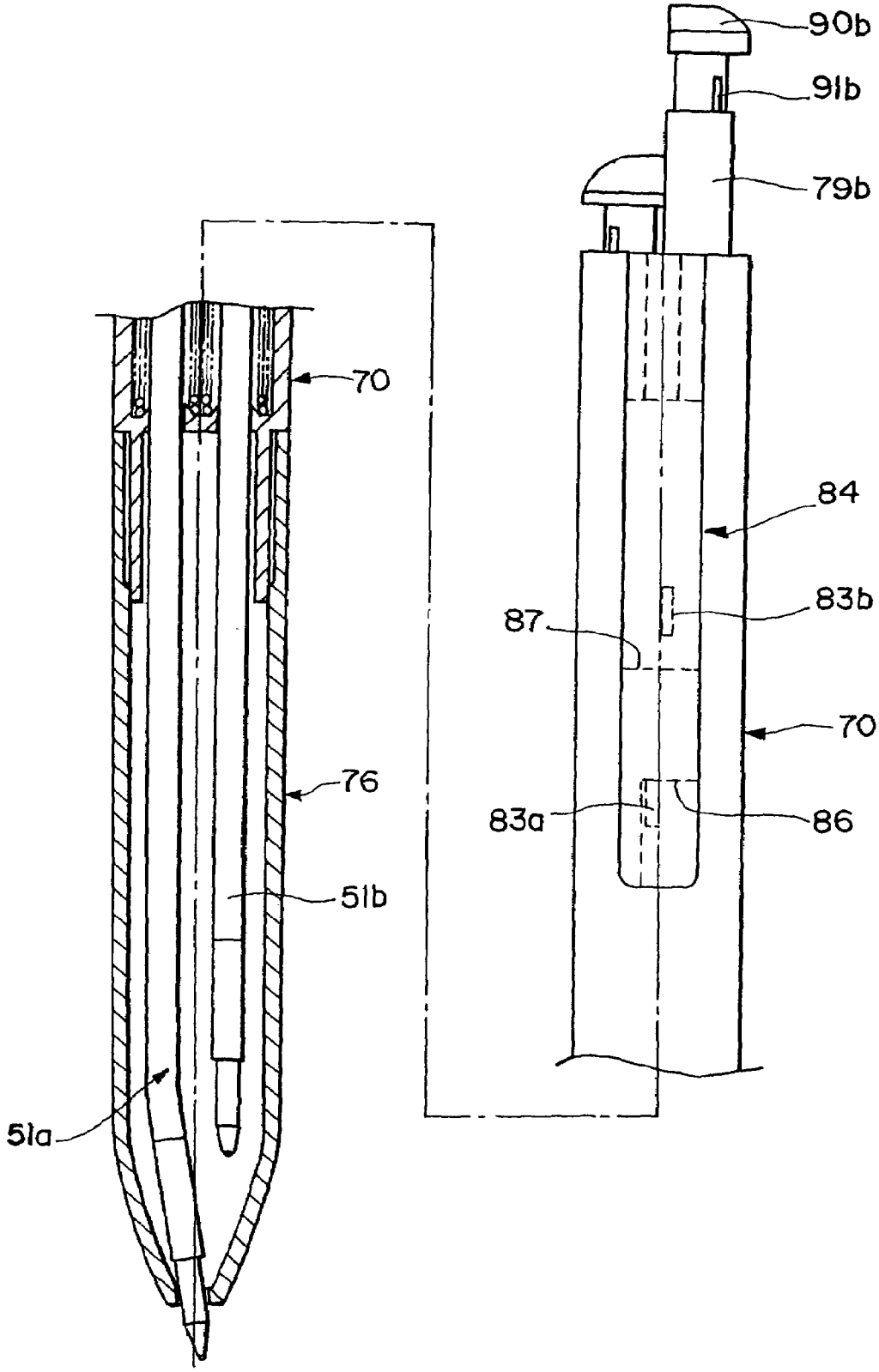
FIG. 16 is another fragmentary longitudinal sectional view from above.
Figure 17:
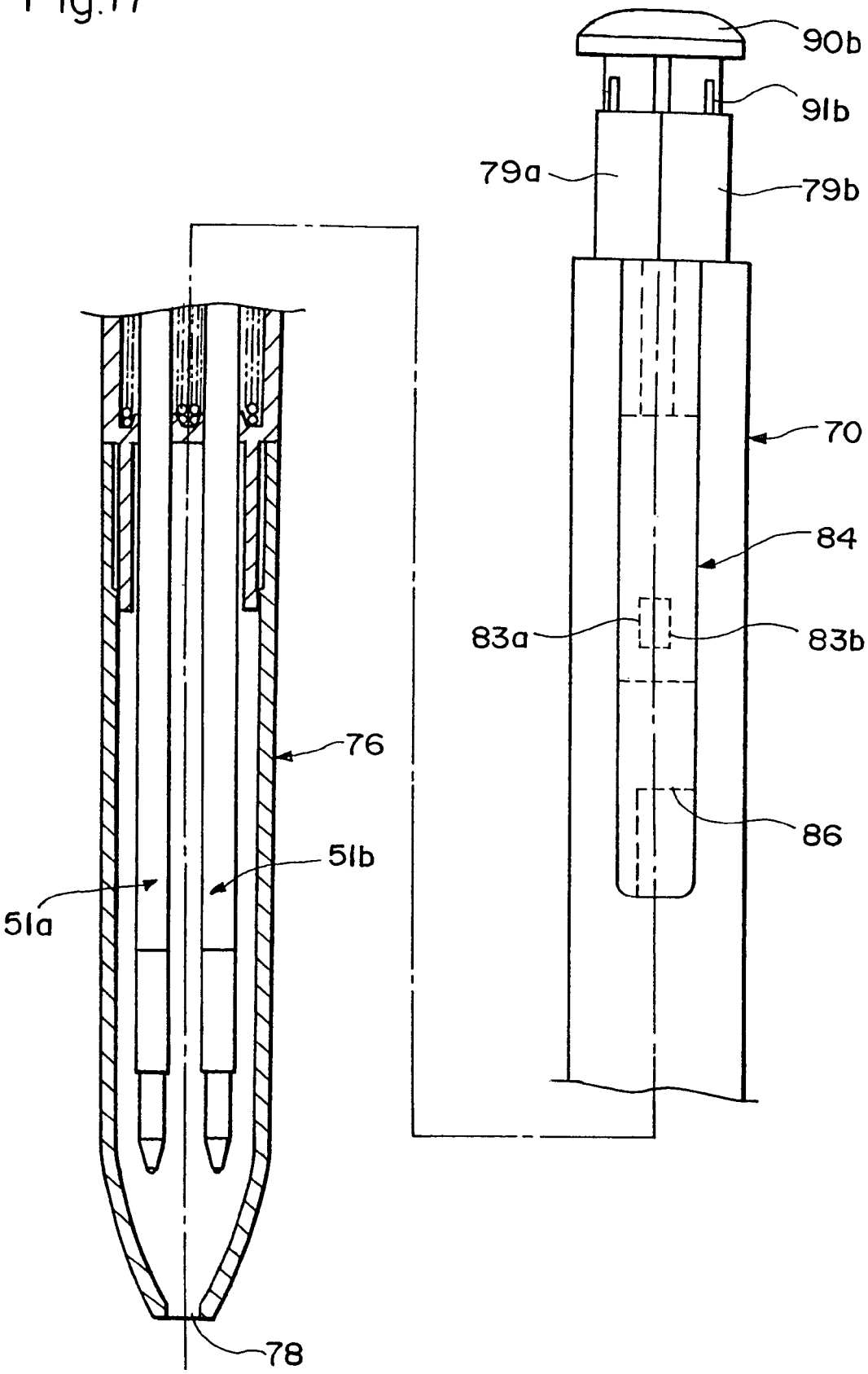
FIG. 17 is another fragmentary longitudinal sectional view showing a situation where the writing tip is retracted.

When the knock body 79*a* is knocked from the state shown in FIG. 17, the engagement projection 83*a* of the ball-point pen refill 51*a* is held in engagement with the engagement step portion 86 of the ball part 85 of the clip as shown in FIG. 14, so that the writing tip portion of ball-point pen refill 51*a* projects from a top end opening 78 of the front body 76. This state is shown in FIGS. 14 through 16.

In addition, in this state, when the side of the ball part 85 is compressed to horizontally deform the clip, the engagement state is released, so that the writing tip portion can be accommodated in the body cylinder.

Next, when the rear end of the other knock body 79*b* is knocked, the engagement projection 83*b* suitably pushes up the rear end portion 87 of the ball part, so that the engagement between the engagement projection 83*a* and the engagement step portion 86 is released. In conjunction with this, the ball-point refill 51*a* retreats.

Further, when the knock body 79*b* moves forward, the engagement projection 83*b* is held in engagement with the engagement step portion 86, the writing tip portion of the ball-point pen refill 51*b* projects from the top end opening 78 of the front body 76.

Further, when either of the writing tip portions of the ball-point pen refills is put into a breast pocket etc., leaving it to project, then the ball part 85 of the clip 84 is pushed up with the cloth, so that the engagement is released and the writing tip portion is accommodated in the front body 76, thereby avoiding a problem that the ink may stain the clothes.

In addition, in order to improve user-friendliness of the above-mentioned engagement release, the clip tip portion is provided so that engagement release can be carried out by way of the horizontal deformation in the example.

However, it is not limited to this example. In the situation where the writing tip portion of one ball-point pen refill has projected, for example, a mechanism may be provided in which the rear end of the knock body of the other one is knocked so that the writing tip portion of the other ball-point pen refill projects in turn.

Next, the main part of the pressurization mechanism portion will be described further. The pumping type pressurization mechanism in the example is provided behind the knock body. In addition, the knock bodies 79*a* and 79*b* are similar to each other, so that one knock body 79*b* will be described hereafter with reference to the drawings.

Figure 18:
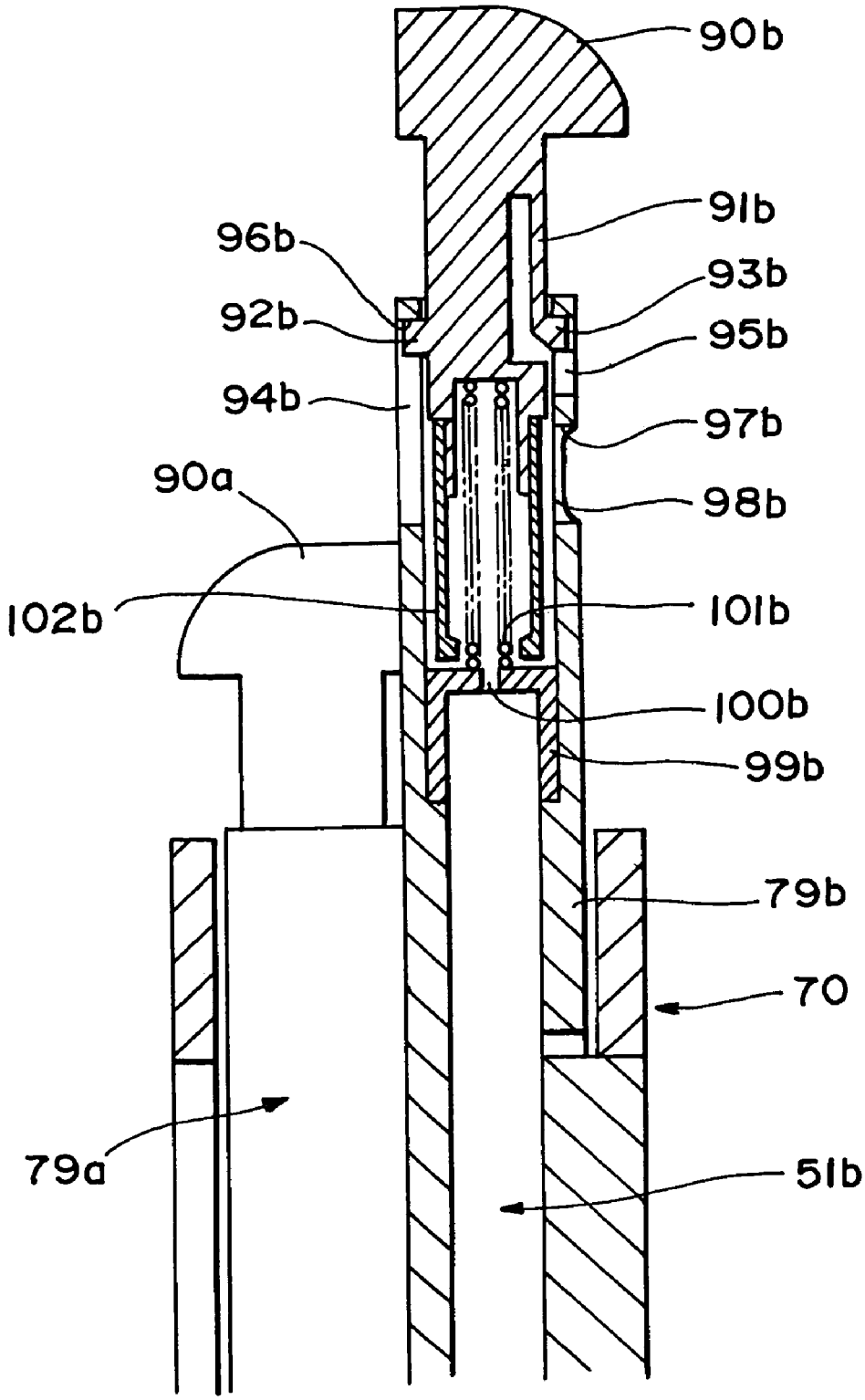
FIG. 18 is an enlarged sectional view showing a pressurization mechanism before being pressed.
Figure 19:
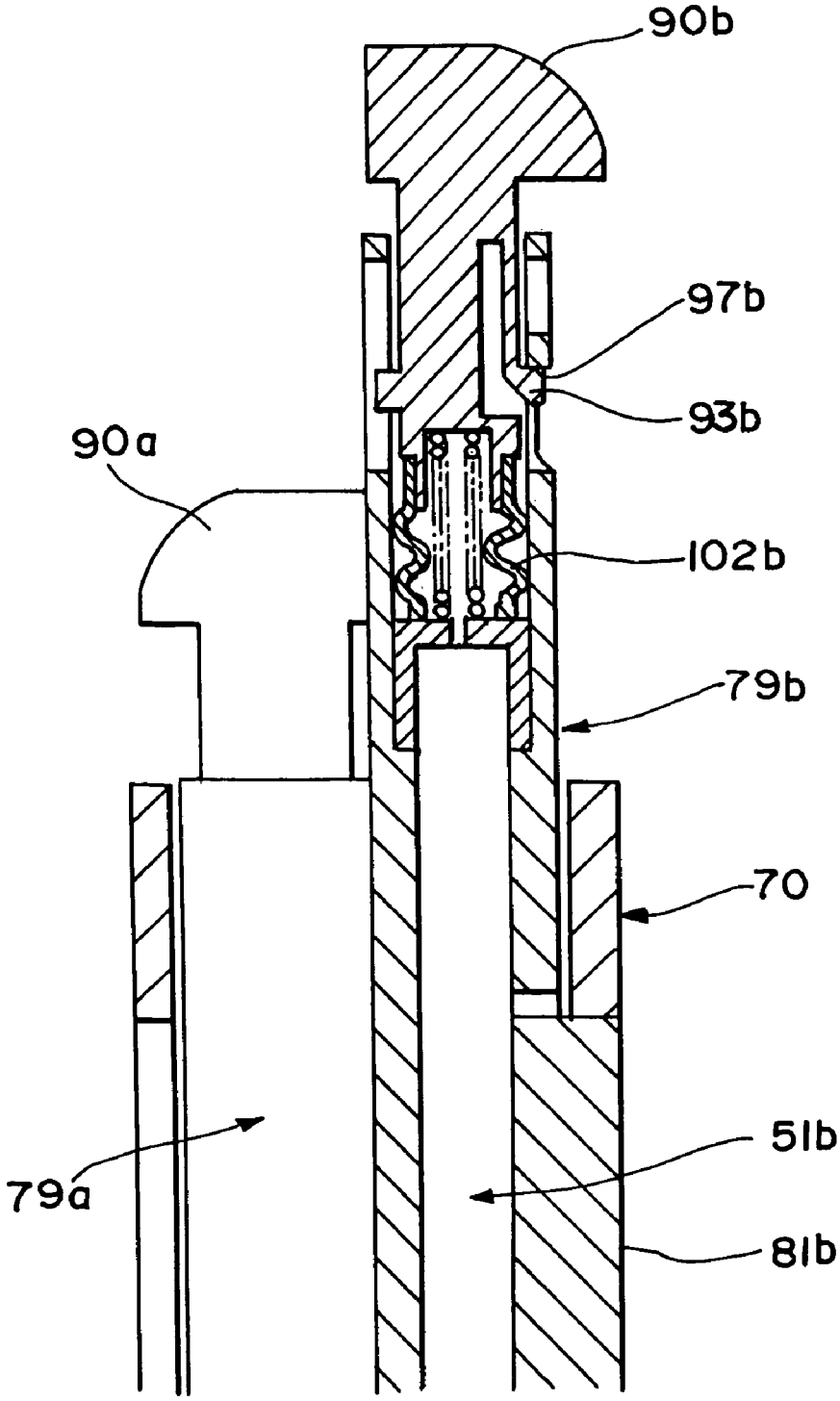
FIG. 19 is an enlarged sectional view showing a pressurization mechanism after being pressed.

Firstly, as shown in FIGS. 18 and 19 the ball-point pen refill 51*b* (not shown) is detachably and closely fitted in front of the inner hole portion of the knock body 79*b* which can be held in engagement in the advanced/retreated position with respect to the body cylinder by way of knock operation.

Further, the pumping type pressurization mechanism is provided behind the inner hole portion of the knock body 79*b*. In the situation where the tip end portion has projected from a front body top, a knock bar 90*b* provided at the rear end of the knock body 79*b* is pressed so as to operate the pumping type pressurization mechanism, whereby air is compressed into the rear end hole of the ink reservoir section which is closely fitted at the front end of the pressurization mechanism portion.

In other words, the rear end of the ball-point pen refill follower is arranged to be pressurized.

A bush 99*b* is fixed in a rear inner hole of the knock body 79*b*. An inner hole rear end of the bush 99*b* is equipped with and in close contact with the rear end of the ball-point pen refill 51*b*. Further, a vent 100*b* is provided in the rear end of the bush 99*b*.

Furthermore, on one side of the rear end portion of the knock body 79*b*, a slit part 94*b* having a predetermined length is formed from the rear end side toward the front. On the other side, a slit part 95*b* and a slit part 98*b* are formed in the back and the front respectively via a partition-like step portion 97*b*.

The knock bar 90*b* is such that a flange part and a shaft part are formed at the rear end and the front respectively. A projecting portion 92*b* is formed on one side of an outer perimeter in the middle of the shaft portion of the above-mentioned knock bar 90*b*; an engagement piece 91*b* which can elastically be displaced is formed on the other side; a hook-like engagement portion 93*b* is formed at the front end of the engagement piece 91*b*.

Further, a seal cylinder body 102*b* made of an elastic body, such as rubber, or a bellows-like soft molded body which can be contracted and expanded is provided so as to closely fit its rear end to an outer perimeter of the front end portion of the shaft part of the knock bar 90*b*.

The knock bar 90*b* is inserted through the rear end of the knock body 79*b*, during which a spring 101*b* is provided between the shaft center part on the front end side of the knock bar 90*b*, and the rear end of the bush 99*b*.

Further, since the projecting portion 92*b* is held in elastic engagement with the rear end 96*b* of the slit part 94*b*, the knock bar 90*b* is always biased by the spring 101*b* backwards with respect to the knock body 79*b*.

Furthermore, at that time, a small gap is formed between the front end of the seal cylinder body 102*b*, and the rear end of the bush 99*b* so that the rear end hole of the ball-point pen refill 51*b* is communicated with open air through the vent 100*b*.

Immediately after the knock bar 90*b* moves forward, the front end of the seal cylinder body 102*b* is brought into intimate contact with the rear end of the bush 99*b* so as to be shut off from open air.

As the knock bar 90*b* advances the seal cylinder body 102*b* is compressed and the internal pressure increases. Air is compressed into the rear end hole of the ball-point pen refill 51*b* with increasing internal pressure, so that the rear end of the follower is pressurized.

Further, at that time, the engagement portion 93*b* is held in engagement with the step portion 97*b* of the knock body, and the knock bar 90*b* is prevented from retreating, whereby the pressurization state is maintained (see FIG. 19).

In addition, the pressurization mechanisms may be provided in both the knock bodies 79*a* and 79*b*, or one mechanism may be provided for either one of them. Further, when a plurality of knock bodies are provided, at least one of the knock bodies is provided with the pressurization mechanism.

Further, in the above-mentioned preferred embodiment, the engagement piece 91*b* is formed at the knock bar 90*b* which can elastically be displaced, the hook-like engagement portion 93*b* is formed at the front end of the engagement piece 91*b*, and the engagement portion 93*b* is held in engagement with the step portion 97*b* of the knock body 79*b*, so as to maintain the situation where the seal cylinder body 102*b* is compressed. However, it is not limited to this example. It is possible to use a conventional mechanism, such as a knock mechanism in which a writing tip portion of a ball-point pen is held in engagement so as to project and retreat from a body end, etc.

Next, operation of the pressurization mechanism will be described hereafter.

When the rear end of knock bar 90*b* is urged to move forward from the state shown in FIG. 18, immediately after the knock bar 90*b* has moved forward, the front end of the seal cylinder body 102*b* is brought into close contact with the rear end of the bush 99*b*, so as to be shut of f from open air. As the knock bar 90*b* further moves forward, the seal cylinder body 102*b* is compressed so that the internal pressure increases. Air is compressed into the rear end hole of the ball-point pen refill 51*b*, with increasing internal pressure, so that the rear end of the follower is pressurized.

Further, at that time, the engagement portion 93*b* is held in engagement with the step portion 97*b* of the knock body, and the knock bar 90*b* is prevented from retreating, so that the pressurization state is maintained (see FIG. 19). Further, from this state, when the engagement portion 93*b* is pushed inward so as to release the engagement with the step portion 97*b*, the knock bar 90*b* retreats and returns to the state of FIG. 18, so that the inside of the seal cylinder body 102*b* is communicated with open air.

The state shown in FIGS. 18 and 19 indicates that a repulsion of the return spring 88*b* which biases the knock body 79*b* backwards along the body is greater than a repulsion of the spring 101*b* when the knock bar 90*b* is held in engagement with the knock body 79*b* in an advanced state.

Therefore, as the rear end of the knock bar 90*b* is further pressed, the knock body 79*b* moves forward from the state of FIG. 19.

However, basically the repulsions of the two types of springs may be reversed. In other words, after the knock body 79*b* is held in engagement with the rear body 70 in an advanced state, the knock bar 90*b* may move forward with respect to the knock body 79*b*.

Furthermore, the knock body 79*b* and the knock bar 90*b* may start advancing together. When expecting strong pressurization, after the knock body 79*b* is held in engagement with the rear body 70 in the advance state, the knock bar 90*b* is usually provided to move forward with respect to the knock body 79*b*. In addition, the knock body 79*a* side is similarly arranged.

FOURTH EXAMPLE OF THE INVENTION

Figure 20:
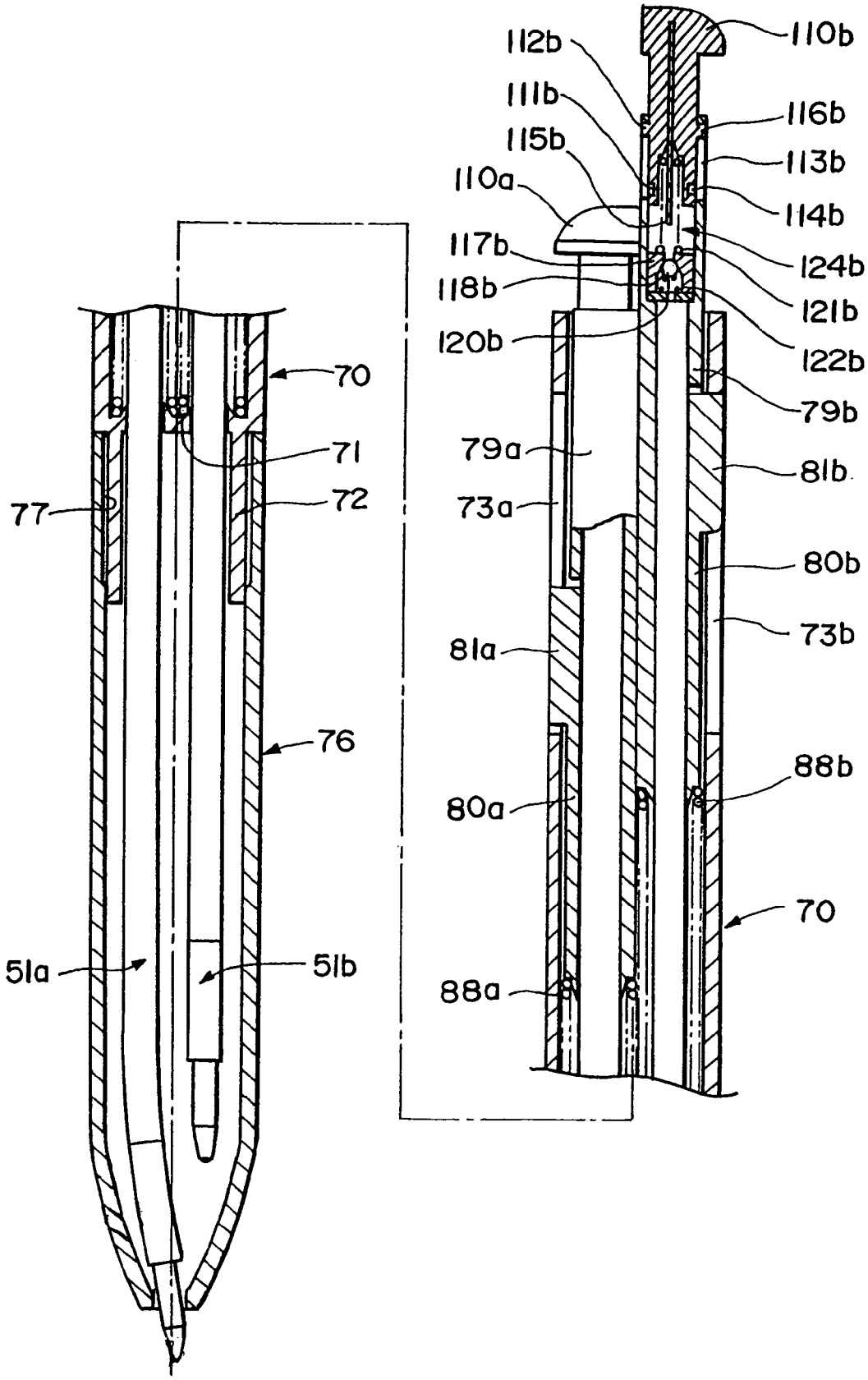
FIG. 20 is a fragmentary longitudinal, sectional view, from above, of the composite writing instrument which is a fourth example of the present invention, and shows a situation where one writing tip projects.
Figure 21:
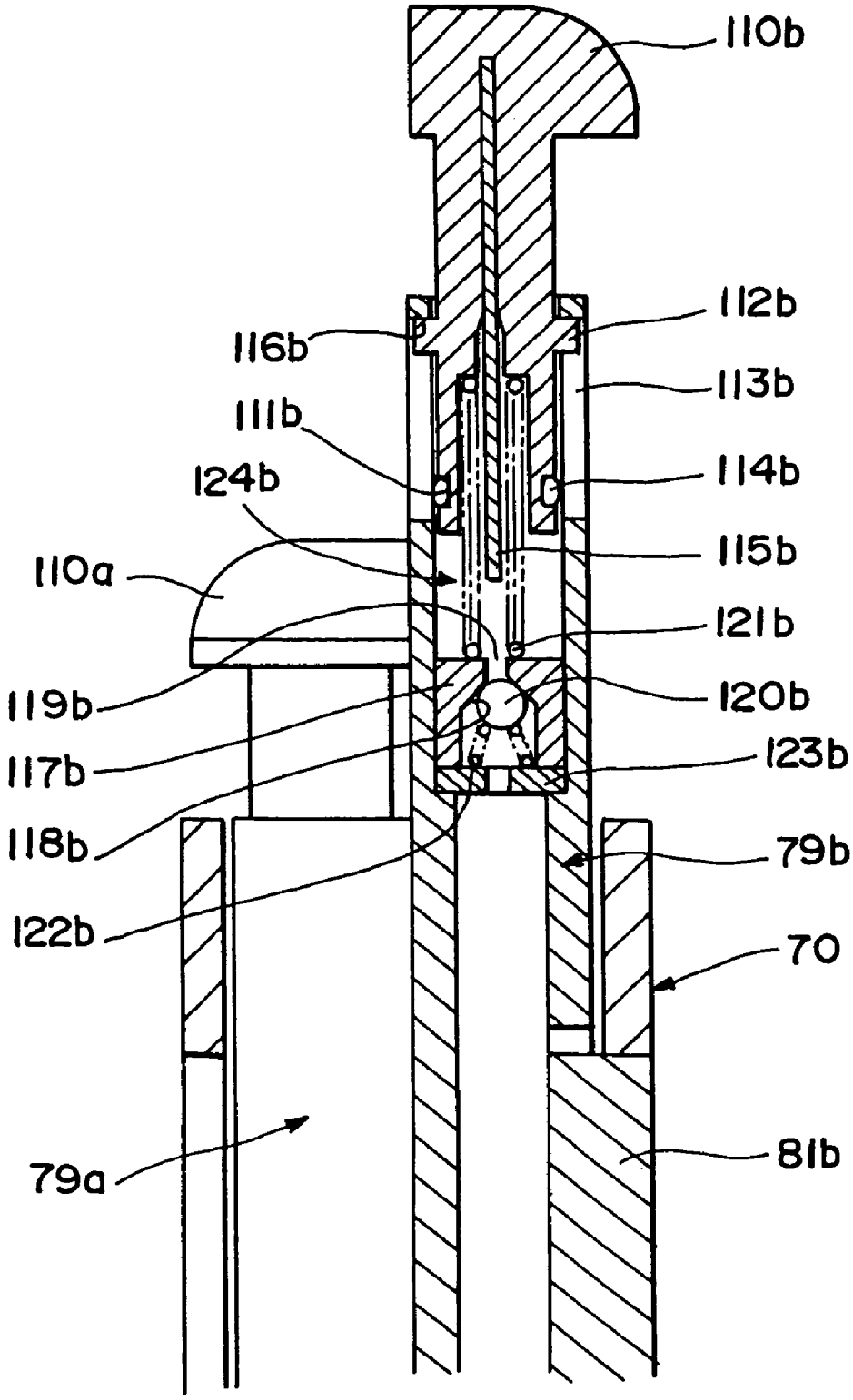
FIG. 21 is an enlarged sectional view showing the pressurization mechanism.

Next, FIGS. 20 and 21 show a fourth example of the present invention.

This fourth example and the third example are different in pressurization mechanisms and other mechanisms are similar to those of the third example, so that like reference signs are used to refer to like parts, and the description of these parts will not be repeated.

The pressurization mechanism of this example is constituted by a valve mechanism portion and a knock mechanism portion, and is provided behind a knock body.

Firstly, the ball-point pen refill 51*b* is detachably and closely fitted in front of the inner hole portion of the knock body 79*b* which can be held in engagement in the advanced/retreated position with respect to the body cylinder by way of knock operation. Further, the pumping type pressurization mechanism is provided behind the inner hole portion of the knock body 79*b*.

In the situation where the tip end portion has projected from the front body top, a knock bar 110*b* provided at the rear end of the knock body 79*b* is pressed so as to operate the pumping type pressurization mechanism, whereby air is compressed into the rear end hole of the ink reservoir section which is closely fitted at the front end of the pressurization mechanism portion, during which the valve is opened at a predetermined pressure so that the rear end of the follower is pressurized.

An outer perimeter of a bush 117*b* is brought into close contact with the rear inner hole of the knock body 79*b*, so as to be fixed thereto. A contact plate 123*b* in the center of which is bored a hole is provided at the front end of the bush 117*b*.

Further, a tapered or sphere-shaped holder seat 118*b* is provided at the substantially rear end of the inner hole of the bush 117*b*. A vent 119*b* is provided at the rear end of, in the axial center of, and through the holder seat.

When the bush 117*b* is fixed in the above-mentioned inner hole of the knock body, the valve 120*b* is inserted in the inner hole of the bush 117*b*, and a spring 122*b* is provided between the valve 120*b* and the contact plate 123*b*.

The valve mechanism portion is constructed such that the valve 120*b* is always in close contact with the holder seat 118*b*.

On the rear end side of the knock body 79*b*, a slit part 113*b* having a predetermined length is formed from the rear end side toward the front.

The knock bar 110*b* is such that a flange part and a shaft part are formed at the rear end and the front respectively. A projecting portion 112*b* is provided at the outer perimeter substantially in the middle of the shaft portion of the knock bar 110*b*. A circumference-like groove part 111*b* is provided at the outer perimeter of a substantially front end of the shaft portion.

Attached to the groove part 111*b* is, as an example, a seal ring 114*b* made of an elastic body, such as rubber, or an elastic molding resin, etc.

In addition, the seal ring 114*b* is selected in view of good airtightness, and a good sliding effect. Further, interposing a lubricant, etc. should be considered. Furthermore, the seal ring part can be formed integrally with the outer perimeter of the shaft portion.

Further, the knock bar 110*b* is inserted through the rear end of the knock body 79*b*. A knock spring 121*b* is provided between the front end of the knock bar 110*b* and the rear end of the bush 117*b*.

A projecting portion 112*b* of the knock bar 110*b* is elastically held in engagement with the rear end 116*b* of the slit part 113*b* and the knock bar 110*b* is always biased by the knock spring 121*b* backwards with respect to the knock body 79*b*, whereby the knock mechanism portion is disposed behind the valve mechanism portion.

When the front of the shaft portion of the knock bar 110*b* is fitted into the rear inner hole of the knock body 79*b*, an outer perimeter part of the seal ring 114*b* is in sliding contact with the inner periphery of the rear inner hole.

At that time, the seal ring 114*b* is located in a state immediately before it reaches a substantial front end of the slit part 113*b*.

Therefore, a space part 124*b* formed between the rear of the valve 120*b* and the front end of the knock bar 110*b* is communicated with open air.

In other words, immediately before the advance actuation of the knock bar 110*b*, the space part 124*b* is communicated with open air.

Immediately after the knock bar 110*b* moves forward suitably, the outer perimeter part of the seal ring 114*b* is brought into close contact with the inner periphery of the inner hole of the knock body, so as to be shut off from open air. As the knock bar 110*b* moves forward, the space part between the bush 117*b* and the knock bar 110*b* is arranged to be reduced and pressurized.

Further, in a state where the knock bar 110*b* is moved forward and the space part is compressed suitably, a protrusion 115*b* provided at the front end of the knock bar 110*b* is brought into contact with the rear end of the valve 120*b* so that the close contact between the valve 120*b* and the holder seat 118*b* of the bush may be released.

Further, although the above-mentioned example illustrates each of the plurality of knock bodies which is provided with an independent pressurization mechanism, a pressurization mechanism may be provided in one position, behind ball-point pen refills, so as to collectively or selectively pressurize a plurality of ball-point pen refills. Further, a valve mechanism portion may integrally be provided in the rear end of a ball-point pen refill, so as to further simplify its structure.

Next, operation of the pumping type pressurization mechanism will be described below.

When the rear end of the knock bar 110*a* is pressed to move forward from a state shown in FIG. 20, the space part between the back of the valve and the front end of knock bar 110*a* is shut off from open air, at the time when the outer perimeter part of the seal ring 114*b* is brought into close contact with the whole inner periphery of the inner hole behind the knock body 79*a*.

When the knock bar 110*a* moves forward further, the outer perimeter part of the seal ring slides in close contact with the inner periphery of the inner hole of the knock body 79*a*, so that the internal pressure rises as the space part is reduced.

Further, in the state where the knock bar 110*a* is moved forward and the space part is suitably compressed, the protrusion provided at the front end of the knock bar 110*a* is brought into contact with the rear end of the valve, so as to release the close contact with the holder seat of the valve.

Thus, the pressurized air is compressed towards into the front of the valve, so that the rear end of the follower is pressurized to help the ink flow towards the tip side.

What is claimed is:

1. A composite writing instrument having mounted a plurality of writing means in a body cylinder including at least one ball-point pen refill equipped with a tip of the ball-point pen at a top end and an ink reservoir section at a rear end so that writing tip portions may be alternately allowed to project and retreat from a front body top, wherein a pumping type pressurization mechanism is provided behind said ball-point pen refill, and a rear end of ink is pressurized by way of knock operation in a situation where a tip end portion has projected from a body end, so as to help the ink flow towards the tip side.

2. The composite writing instrument as claimed in claim 1, wherein the pumping type pressurization mechanism is provided behind a knock cylinder to be equipped with the ball-point pen refill, a slide member is provided which holds a writing tip portion at the rear end of said pressurization mechanism so as to project and retreat from a body of the writing instrument, a knock portion is provided projecting from the rear end of the slide member, and said knock portion is operated so that the rear end of the ink is pressurized to help the ink flow towards the tip side.

3. The composite writing instrument as claimed in claim 2, wherein the pumping type pressurization mechanism is provided with a valve mechanism portion, in the knock cylinder, which always shut air ventilation to the rear end side of the ball-point pen refill, and a piston, behind the valve mechanism portion, which compresses a space part formed between the piston and the valve mechanism portion; a knock pin allowing the piston to move is provided as the knock portion;

the rear end of ink is pressurized by operating said knock portion so as to help the ink flow towards the tip side.

4. The composite writing instrument as claimed in claim 3, wherein a protrusion is provided which is brought into contact with the front end of the knock pin or the rear end of a valve part so that the shut-off state of the valve mechanism portion may be released when the piston is moved forward and the space part is compressed suitably.

5. The composite writing instrument as claimed in claim 1, further comprising a pressurization mechanism portion provided with a pressurization cylinder which is closed at its rear end and provided between the rear end of the ball-point pen refill and the front end of a knock operation part, and a pressurization shaft which slides the pressurization cylinder against a spring provided in an inner hole of the pressurization cylinder, wherein the tip end portion is held and left in a situation where it has projected, and a knock bar is knocked so as to move the pressurization cylinder forwards with respect to the pressurization shaft and leave the rear end of the ink pressurized.

6. The composite writing instrument as claimed in claim 5, wherein an air passage is provided, on an outer perimeter of the pressurization shaft, which is formed at the front end portion in a circumference-like groove part and communicates between the groove part and a hole portion which is bored through a shaft center of the pressurization shaft, when a seal ring is closely inserted in said groove so as to move back and forth and the pressurization cylinder moves forward with respect to the pressurization shaft, the outer perimeter part of the seal ring slides in close contact with the inner periphery of the pressurization cylinder, in a situation where the seal ring is urged towards the front end side of the groove and said air passage is closed, so that air in the pressurization cylinder is compressed into the inner hole of the shaft center of the pressurization shaft.

7. The composite writing instrument as claimed in claim 1, further comprising a knock bar subjected to said knock operation, a knock body provided between a front end of said knock bar and the rear end of said ball-point refill, and a spring provided between said knock body and said knock bar, said knock body being detachably equipped with said ball-point pen refill, a rear of the knock bar projecting beyond said knock body while said knock bar is engaged with said knock body such that said knock bar can move forward, and an elastic seal cylinder body having an open front end forwardly of said knock bar, the pumping type pressurization mechanism is provided in which a rear end hole of an ink reservoir section is shut off from open air as the knock bar moves forward, the seal cylinder body is contracted so as to compress air into the rear end hole of the ink reservoir section, and allow the rear end of the ink to be pressurized, to thereby help the ink flow towards the tip side.

* * * * *